US006266039B1

(12) United States Patent
Aoki

(10) Patent No.: US 6,266,039 B1
(45) Date of Patent: Jul. 24, 2001

(54) LIQUID CRYSTAL DEVICE, METHOD FOR DRIVING THE SAME, AND PROJECTION DISPLAY AND ELECTRONIC EQUIPMENT MADE USING THE SAME

(75) Inventor: Toru Aoki, Shiojin (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/254,873

(22) PCT Filed: Oct. 8, 1997

(86) PCT No.: PCT/JP97/03600

§ 371 Date: Mar. 15, 1999

§ 102(e) Date: Mar. 15, 1999

(87) PCT Pub. No.: WO99/04384

PCT Pub. Date: Jan. 28, 1999

(30) Foreign Application Priority Data

Jul. 14, 1997 (JP) ..... 9-203792

(51) Int. Cl.[7] ..... G09G 3/36
(52) U.S. Cl. ..... 345/94; 345/95; 345/96
(58) Field of Search ..... 345/95, 96, 209, 345/210, 98, 94, 100

(56) References Cited

U.S. PATENT DOCUMENTS

| | | | | |
|---|---|---|---|---|
| 5,151,805 | * | 9/1992 | Takeda et al. | 359/57 |
| 5,426,447 | * | 6/1995 | Lee | 345/103 |
| 5,510,807 | * | 4/1996 | Lee et al. | 345/103 |
| 5,555,001 | * | 9/1996 | Lee et al. | 345/93 |
| 5,790,092 | * | 8/1998 | Moriyama | 345/96 |
| 5,892,493 | * | 4/1999 | Enami et al. | 345/94 |
| 5,949,398 | * | 9/1999 | Kim | 345/100 |
| 5,973,658 | * | 10/1999 | Kim et al. | 345/92 |
| 6,031,515 | * | 2/2000 | Okamoto | 345/100 |
| 6,104,367 | * | 8/2000 | McKnight | 345/94 |
| 6,115,018 | * | 9/2000 | Okumura et al. | 345/95 |

FOREIGN PATENT DOCUMENTS

| | | |
|---|---|---|
| 63-41829 | 2/1988 | (JP) . |
| 2-204718 | 8/1990 | (JP) . |
| 4-321093 | 11/1992 | (JP) . |
| 5-224625 | 9/1993 | (JP) . |
| 6-377400 | 12/1994 | (JP) . |

* cited by examiner

*Primary Examiner*—Richard Hjerpe
*Assistant Examiner*—Kevin M. Nguyen
(74) *Attorney, Agent, or Firm*—Oliff & Berridge. PLC

(57) ABSTRACT

The invention relates to a liquid crystal apparatus which is capable of reducing deterioration of image quality owing to optical cross-talk. The data signal supplied to the data signal line changes within a range of negative polarity data voltage amplitude between a first potential and a second potential at the time of applying negative polarity voltage to the liquid crystal layer. The data signal supplied thereto changes within a range of negative polarity data voltage amplitude between a third potential and a fourth potential at the time of applying positive polarity voltage to the liquid crystal layer. Before supplying this data signal to the data signal line, the data signal line is pre-charged by a negative polarity pre-charging potential and a positive polarity pre-charging potential. The positive and negative polarity pre-charging potentials are set so as to be non-symmetrical to the center potential of the data voltage amplitude. Further, the negative polarity pre-charging potential is set so as to be closer to the first potential than the center potential of the positive data voltage amplitude.

19 Claims, 18 Drawing Sheets

| | S1 | S2 | S3 | S4 |
|---|---|---|---|---|
| H1 | + | − | + | − |
| H2 | − | + | − | + |
| H3 | + | − | + | − |
| H4 | − | + | − | + |

FIG. 11

| | S1 | S2 | S3 | S4 |
|---|---|---|---|---|
| H1 | − | + | − | + |
| H2 | + | − | + | − |
| H3 | − | + | − | + |
| H4 | + | − | + | − |

FIG. 12

LIQUID CRYSTAL DEVICE, METHOD FOR DRIVING THE SAME, AND PROJECTION DISPLAY AND ELECTRONIC EQUIPMENT MADE USING THE SAME

BACKGROUND OF THE INVENTION

The present invention relates to a liquid crystal apparatus, a driving method thereof, and a projection-type display apparatus and electronic equipment using the liquid crystal apparatus.

DESCRIPTION OF THE RELATED

For example, with an active-matrix type liquid crystal apparatus, action of writing data to the liquid crystal layer of each pixel is executed by point-at-a-time driving, via switching elements such as a plurality of TFTs (thin-film transistors) connected to a scanning signal line.

Also, in order to prevent unevenness in the display owing to imbalance in potential applied to the liquid crystal, and in order to prevent deterioration and so forth of the liquid crystal due to the direct current applied to the liquid crystal, polarity inversion driving is performed, wherein the polarity of the voltage applied to the liquid crystal is inverted at a certain time.

Polarity inversion driving is a method of driving wherein voltage is applied to one end of the liquid crystal, the polarity (positive or negative polarity) of this voltage being opposite to a reference potential applied to the other end of the liquid crystal. Incidentally, in the present Specification, the term "polarity" refers to the polarity of the voltage applied to both ends of the liquid crystal. In order to perform polarity inversion driving width an active-matrix type device using TFTs, either the potential applied to the common electrode opposing the pixel electrode across from the liquid crystal is changed, or the potential level of the image data signal is changed as to a reference center potential of the voltage amplitude of the image data signal applied to the pixel electrode.

Known types of polarity inversion driving methods involve inversion by line wherein polarity inversion is performed each time a scanning signal line is selected, or inversion by line combined with inversion by dot wherein polarity inversion is performed for each pixel connected to one scanning signal line.

FIG. 11 and FIG. 12 are models for describing the polarity inversion driving method. With conventional active-matrix type liquid crystal apparatus, a polarity inversion driving method has been employed wherein point-at-a-time driving is performed and inversion driving is performed for each pixel (including for each line), and wherein pre-charging of the data signal lines is performed collectively during the blanking period immediately before.

In FIG. 11 and FIG. 12, S1 through S4 represent data signal lines, and H1 through H4 represent scanning signal lines. The "+" and "−" for each pixel represent the voltage applied to the liquid crystal of each pixel, and the polarity of the pre-charge potential supplied to the data signal lines immediately prior to the application of the voltage. FIG. 11 represents the voltage polarity of each pixel at field N, and FIG. 12 represents the voltage polarity of each pixel at field N+1. Regarding polarity inversion driving per pixel and per line, the arrangement is such that differing polarity voltage is applied to each neighboring pixel connected to the same data signal line (each neighboring pixel in the vertical direction in FIG. 11 and FIG. 12).

In this case, even when waiting the same black data, for example, on the display to two neighboring pixels which are connected to the sane data signal line and connected to different scanning signal lines, the signal level for each of the pieces of black data differs, due to the polarity inversion driving. At this time, the data signal line itself has parasitic capacity, so time is required for changing the potential of the data signal line from the black level potential on the positive polarity side to the black level potential on the negative polarity side.

With reference to FIG. 13 and FIG. 14, a description will be given regarding change in the potential of the data signal line when writing the same black data to two neighboring pixels which are connected to the same data signal line.

In FIG. 13, C10 represents the parasitic capacity of the data signal line S1 (i.e., the equivalent capacity of the data signal line S1). Also, the "−" and "+" noted to the left side of FIG. 13 represents the polarity of the voltage written to the pixels 22 and 24. Incidentally, the pixels 22 and 24 are both to display "black". The pixels are comprised of a storage capacity and a pixel electrode to which data signals are supplied via a switching element, and a liquid crystal layer to which voltage is applied between the pixel electrode and common electrode.

As shown in FIG. 14, during the horizontal scanning time T1, black level potential B1 is applied to one end of the pixel 22 and black is displayed, and during the next horizontal scanning time T2, black level potential B2 is applied to one end of the pixel 24 and black is displayed. In this case, a common potential set between the black levels B1 and B2 is applied to the other end of the pixels 22 and 24, so that voltage of a negative polarity is applied to the pixel 22, and voltage of a positive polarity is applied to the pixel 24, thus inverting the polarity of the voltage applied to the liquid crystal for the same black display. Moreover, with a normally-white display such as described above, the difference in potential between the black level potentials B1 and B2 is greatest, as compared with display of other gray scale. Accordingly, in the event that pre-charging is not performed, the parasitic capacity C10 of the data signal line S1 must be charged (or discharged) by means of the image data signal itself, so as to change the potential of the data signal line from the black level potential B1 to B2, as represented by "R1" in the Figure.

Conversely, by means of performing pre-charging of the same polarity as the polarity of the data signal before supplying the data signal i.e., by means of performing pre-charging before the horizontal scanning time T2 so as to maintain the data signal line S1 at the high-voltage second pre-charging potential PV2, as shown as "R2" in the Figure, all that is necessary is to change the potential of the data signal line from the pre-charging potential PV2 to the black level voltage B2, so the amount of charging (discharging) of the parasitic capacity of the data signal line S1 dose not have to be great. Accordingly, driving of the liquid crystal is increased in speed Now, regarding conventional liquid crystal apparatus, the arrangement has been such that the black level potentials B1 and B2 are respectively set at 1V and 11V, the white level potentials W1 and W2 are respectively set at 5V and 7V, and the pre-charging potentials PV1 and PV2 are respectively set at 4V and 8V. That is to say, the pre-charge potentials PV1 and PV2 have been set symmetrically to the center potential (6V) between the black level potentials B1 and B2, which are the video amplitude.

The 4V and 8V are voltages which are applied to one end of the liquid crystal via a switching element at the time of displaying intermediate gray scale, and are equivalent to the potential level at the time that the T-V curve, which represents the relation between the voltage applied to the liquid crystal (V) and the transmittance of the liquid crystal apparatus (T), becomes the steepest. In other words, 4V and 8V are equivalent to potential levels at the time that the change in transmittance corresponding to change in voltage applied to the liquid crystal is the greatest. By means of setting the pre-charging potentials PV1 and PV2 as such, the data signal line can be charged or discharged in a short time from the precharging potential to a potential for intermediate gray scale display, so accurate intermediate gray scale display can be realized even in the event that the sampling period is reduced.

Now, optical cross-talk is a problem with liquid crystal apparatus which perform liquid crystal display using light from a light source, e.g., projection-type liquid crystal apparatus such as projectors. Optical cross-talk is a phenomena which occurs when a carrier is generated due to light in a switching element such as a TFT (thin-film transistor) formed on a substrate, the charge stored in the pixel connected to the TFT leaks, whereby the charge stored in the pixel is affected by the potential of the source line (data signal line) connected to the TFT and changes. While this problem itself is a conventional problem, the present Inventor has discovered the relationship between optical cross-talk and pre-charging potential. This shall be described with reference to FIGS. 15 through 17.

FIG. 15 shows a screen where a center area A displays black and a surrounding area B displays an intermediate gray scale. The data signal line Sn is connected only to the pixels which display the intermediate gray scale, and the data signal line Sn+i is connected to the pixels which display the intermediate gray scale and display black. Also, of the pixels of the intermediate gray scale display area B, the pixel which is connected to the data signal line Sn is denoted by A(m, n), and the pixel which is connected to the data signal line Sn+i is denoted by A(m, n+i).

FIG. 16 is a schematic explanatory diagram for describing charge leakage when driving both pixel A(m, n) and pixel A(m, n+i) with positive voltage. In FIG. 16, attempting to apply voltage of 8V to one end of pixel A(m, n) and pixel A(m, n+i) via the data signal lines Sn and Sn+i, the liquid crystal layer of each pixel is charged with a voltage which is actually ΔV1 lower than 8V. The reason is: with an N-channel transistor as the switching element, at the time of applying high-voltage to the gate of this transistor to turn it ON and charge the pixel, the charge which has been charged in the parasitic capacity between the gate^drain (elecrode to the side of the pixel electrode) of the transistors flows to the storage capacity and pixel electrode side at the time of the transistor going OFF, thereby generating a voltage fall of ΔV1.

Another reason is: with an N-channel transistor as the sampling switch connected to each of the data signal lines Sn and Sn+i, a voltage fall of ΔV2 occurs owing to the parasitic capacity between the gate^drain (electrodes to the data line side) of the transistors, due to the same action as above.

With both the switching element and the sampling switch as N-channel transistors, the above two types of voltage falls means that the voltage charged in the liquid crystal layer is lower than the data voltage before sampling. The voltage fall ΔV approximates ΔV=ΔV1 +ΔV2.However, the following description will only take into consideration the voltage fall from the switching element.

Now, the pixel A(m, n) to which is applied a charge voltage lower than 8V via the switching element is affected by the pre-charging potential which is lower than or higher than the charging voltage, and the potential of the data signal line Sn to which is applied 4V or 8V which is data potential, whereby leakage occurs at the switching element. Also, the pixel A(m, n+i) to which a charge voltage lower than 8V is applied via the switching element is affected by the potential of the data signal line Sn+i to which is applied 1V or 11 v which is black level data signal potential lower than or higher than the charging voltage, whereby leakage occurs at the switching element. That is to say, in the event that both the pixels A(m, n) and A(m, n+i) are charged with a positive polarity intermediate gray scale display voltage, leakage occurs between data signal lines to which are applied pre-charge potential higher than and lower than this charging voltage, or data signal potentials higher than and lower than this, and the charges in the pixels are alternately charged and discharged via the switching elements, so as a result, there are less effects of the potential of the data signal lines thereupon.

FIG. 17 is a schematic explanatory diagram for describing charge leakage when charging pixel A(m, n) and pixel A(m, n+i) with negative polarity voltage. In FIG. 17, attempting to apply voltage of 4V to pixel A(m, n) and pixel A(m, n+i) via the data signal lines Sn and Sn+i, the liquid crystal layer of each pixel is applied with a voltage which is actually ΔV1 lower than 4V. The reason is the same as given above.

The pixel A(m, n) to which is applied a charge voltage lower than 4V is affected by the potential of the data signal line Sn to which is applied 4V or 8V which is a pre-charge potential higher than the charging voltage and data signal potential, whereby leakage occurs at the switching element. Accordingly, regarding pixel A(m, n) in the event of negative polarity voltage driving, leakage occurs between the data signal lines which are constantly at a higher potential which is higher than the charging voltage, so that the charge is charged from the data signal lines such that the charge voltage constantly shifts in the positive direction.

On the other hand, the pixel A(m, n+i) to which a charge voltage lower than 4V is applied switching element is affected by the potential of the data signal line Sn+i to which is applied 1V or 11 v which is black level data signal potential lower than or higher than the charging voltage, whereby leakage occurs at the switching element. Accordingly, in the event that the pixel A(m, n+i) is charged with a negative polarity voltage, the charged charge voltage alternately shifts in the positive and negative directions, and consequently, there are less effects of the potential of the data signal lines thereupon.

From the above, the present Inventor has discovered that deterioration of the image owing to optical cross-talk is markedly manifested at the time of applying negative polarity voltage, as described with reference to FIG. 17. The reason is: at the time of applying negative polarity voltage, the voltage charged in the pixel A(m, n) constantly shifts in the positive direction one-sidely, i.e., toward the direction of white display, so there is a difference of display gray scale between the pixel A(m, n) and pixel A(m, n+i) which should be displaying the same gray scale, and the difference in gray scale therebetween is increased.

In the event that the switching element is formed of a P-channel transistor, the shift ΔV1 owing to the parasitic capacity of the transistor raises the charge voltage by ΔV1. That is, the potential relation in FIGS. 16 and 17 with the voltage Vc as the reference is reversed, such that the upper side of voltage Vc is negative polarity and the lower side of voltage Vc is positive polarity, and with such an arrangement, FIG. 16 shows negative polarity voltage driving, and FIG. 17 shows positive polarity voltage driving. In such a case, in the event that the charging voltage is of positive polarity (equivalent to the lower side in FIG. 17) at the pixel A (m, n) in FIG. 17, it has been shown that the same phenomena as described above occurs and charge flows out onto the data signal line, and the charge voltage of pixel A(m, n) shifts continuously in the negative direction (equivalent to the upper side in the Figure), showing that deterioration of the image owing to optical cross-talk is marked at the time of applying positive polarity voltage.

With regard to other problems, in recent years, there is demand for highly precise liquid crystal display, and as the number of pixels on one scaring line increase, the frequency of the sampling signals of the data signals becomes higher. At this time, switching noise is generated by the sampling switch which is driven by the high-frequency sampling signals, and this is superimposed on the data signals lines. In the event that the sampling period is short, the sampling ends before the effects of the switching noise disappear, making it impossible to apply the original data to the liquid crystal layer.

SUMMARY OF THE INVENTION

Accordingly, it is an object of the present invention to provide a liquid crystal apparatus, a displaying method thereof, and a projection-type display apparatus and electronic equipment using the liquid crystal apparatus, whereby image deterioration owing to optical cross-talk can be reduced.

It is another object of the present invention to provide a liquid crystal apparatus, a display method thereof, and a projection-type display apparatus and electronic equipment using the liquid crystal apparatus, whereby defective writing of data signals accompanying increased frequency of the data sampling signals can be suppressed, thereby supplying voltage true to the original data signal to the liquid crystal layer, thus improving image quality.

According to one aspect of the present invention, a liquid crystal apparatus is comprised of switching elements which are electrically connected to a liquid crystal layer being provided to each of a plurality of pixels formed by crossing a plurality of data signal lines and a plurality of scanning signal lines, is driven by inverting the polarity of the voltage applied to the liquid crystal layer at a predetermined interval, and also comprises: scanning-side driving means for supplying to the plurality of scanning signal lines scanning signals which select at least one of the plurality of scanning signal lines; data-side driving means for supplying the data signals to the plurality of data signal lines; and a plurality of pre-charging switching means which pre-charge each of the plurality of data signal lines with a positive or negative pre-charge potential which has the same polarity as the voltage applied to the liquid crystal layer of the pixels based on the data signals, before the data signals are supplied to each of the plurality of data signal lines; wherein at the time of applying negative polarity voltage to the liquid crystal layer, the data signals change within a range of a negative data voltage amplitude between a first potential and a higher second potential, and at the time of applying positive polarity voltage to the liquid crystal layer, the data signals change within a range of a positive data voltage amplitude between a third potential higher than the second potential and an even higher fourth potential; and wherein the positive polarity and negative polarity pre-charge potentials are set so as to be non-symmetrical to the center potential of the data voltage amplitude between the first and fourth potentials, and also such that the negative polarity pre-charge potential is set so as to be closer to the first potential than the center potential of the negative polarity data voltage amplitude.

According to the present invention, the data signal line is pre-charged by a negative polarity pre-charging potential set to be closer to the first potential than the potential for intermediate gray scale display. That is, according to the present invention, the pre-charge potential closer to the first potential is periodically applied to the data signal line, regardless to the gray scale level of the pixel connected to the data signal line. Accordingly, in the event that the pixel is charged with a charge voltage of a negative polarity of intermediate gray scale display, even in the event that optical cross-talk occurs due to the switching element of the pixel, a negative polarity pre-charging potential lower than the charged charging voltage is periodically applied to the data line to which the pixel is connected, and further, since a positive polarity pre-charging potential higher than the charged charging voltage and data signal potential are periodically applied, so there is no one-way shift to the positive polarity side as described in FIG. 17, thereby reducing the deterioration in image quality due to leakage from the switching element.

More specifically, the present invention can be applied in the event that each of the plurality of switching elements are formed of N-channel transistors. For example, by means of changing the pre-charging potential PV1 shown in FIG. 17 to a value close to the first potential (B1) as shown in FIG. 2, even in the event there is leakage from the switching elements of the pixel A(m, n) and pixel A(m, n+i), both the data signal lines Sn and Sn+i connected to the pixels are subsequently periodically applied with a negative polarity pre-charging potential close to the first potential (black level potential B1 shown in FIG. 2) and a positive polarity pre-charging potential. Accordingly, even in the case that negative polarity intermediate gray scale display voltage is to be applied to the pixels, both pixels A(m, n) and A(m, n+i) exhibit leakage between data signal lines which are alternately applied with positive and negative voltage corresponding with this voltage, unlike the arrangement shown in FIG. 17. Hence, deterioration of image quality owing to optical cross-talk can be reduced.

Setting the negative polarity pre-charging potential as described above is advantageous even in cases that each of the plurality of sampling switching means are formed of N-channel transistors. In this case, turning ON the sampling switching means generates switching noise which is superimposed on the data signal lines. Now, this switching noise has undesirable effects in that the time for discharging the potential of the data signal lines in the negative direction is extended, and particularly, prevents the potential of the data signal line from being discharged until it is at the first potential which is the lowest data signal potential within the sampling period. Accordingly, bringing the negative polarity pre-charging potential closer to the first potential and lessening the potential difference between the negative polarity pre-charging potential and the first potential compensates for the data signal line reaching the first potential within the sampling period.

Now, it is preferable that the negative polarity pre-charging potential be higher than the first potential. In the event that the negative polarity pre-charging potential is lower than the first potential, there is no voltage difference between the gate/source of the N-channel transistor, and leakage occurs.

Also, it is preferable that the positive polarity pre-charging potential be lower than the third potential. The above-described switching noise operates to reduce the time for charging the potential of the data signal line in the positive direction. Accordingly, even in the event of setting the data signal line potential to be any of the data signal potentials between the third potential and fourth potential following pre-charging by the positive polarity pre-charging potential which is lower than the third potential, all that is necessary is to constantly charge the data signal line, and this charging can be sped up using the switching noise.

According to another aspect of the present invention, the positive polarity pre-charging potential can be set to be closer to the fourth potential than the center potential of the positive polarity voltage amplitude.

In this case, the data signal line is pre-charged by the positive polarity pre-charging potential which is set closer to the fourth potential than the potential for intermediate gray scale display. Accordingly, even in the event that optical cross-talk occurs due to the switching element of the pixel, the pixel is alternately affected by the potential of the data signal line which is alternately set between a positive polarity pre-charging potential close to the fourth potential and a negative polarity pre-charging potential, so there is no one-way shift to the negative polarity side as described above, thereby reducing the deterioration in image quality due to leakage from the switching element.

More specifically, the present invention can be applied in the event that each of the plurality of switching elements are formed of P-channel transistors. For example, by means of changing the positive polarity pre-charging potential PV1 to a value close to the fourth potential as shown later in FIG. 7, even in the event the voltage charged in the pixel A(m, n) and pixel A(m, n+i) is affected on the potential of data signal line by optical leaking of the switching elements, both the data signal lines Sn and Sn+i are periodically applied with a positive polarity pre-charging potential close to the fourth potential (black level potential B2 shown in FIG. 7) and a negative polarity pre-changing potential. Accordingly, even in the case that positive polarity gray scale voltage is to be charged to the pixels, both pixels A(m, n) and A(m, n+i) exhibit leakage between data signal lines which are alternately applied with positive and negative voltage corresponding with this voltage, so effects of the data signal lines is reduced. Accordingly, deterioration of image quality owing to optical cross-talk can be reduced.

Setting the positive polarity pre-charging potential as described above is advantageous even in cases that each of the plurality of sampling switching elements are formed of P-channel transistors. In this case, turning ON the sampling switching means generates switching noise which is superimposed on the data signal lines. Now, this switching noise has undesirable effects in that the time for discharging the potential of the data signal lines in the positive direction is extended, and particularly, prevents the potential of the data signal line from being charged until it is at the fourth potential which is the highest data signal potential within the sampling period. Accordingly, bringing the positive polarity pre-charging potential closer to the fourth potential and lessening the potential difference between the positive polarity pre-charging potential and the fourth potential compensates for the data signal line reaching the fourth potential within the sampling period.

Now, it is preferable that the positive polarity pre-charging potential be lower than the fourth potential. In the event that the positive polarity pre-charging potential is higher than the fourth potential, there is no voltage difference between the gate/source of the P-channel transistor, and leakage occurs.

Also, it is preferable that the negative polarity pre-charging potential be higher than the second potential. The above-described switching noise operates to reduce the time for discharging the potential of the data signal line in the negative direction. Accordingly, even in the event of setting the data signal line potential to be any of the data signal potentials between the second potential and first potential following pre-charging by the negative polarity pre-charging potential which is higher than the second potential, all that is necessary is to constantly discharge the data signal line, and this charging can be sped up using the switching noise.

Incidentally, the switching element used in the present invention need not be restricted to a thin-film transistor such as shown in the embodiments, but can be formed of a MOS transistor in the event that the device-forming substrate for the liquid crystal panel be formed of a single-crystalline silicone substrate. Also, this can be formed of a two-terminal non-linear element such as a MIM.

It is preferable that the above liquid crystal apparatus according to the present invention be used as a light valve for modulating light source light in a projection-type display device, particularly from a perspective of reducing deterioration in image quality owing to optical cross-talk. Also, the present invention is advantageous in various types of electronic equipment having transmitting or reflecting liquid crystal apparatus using a light source.

BRIEF DESCRIPTION OF THE DRAWINGS

FIG. 11 is a schematic explanatory diagram illustrating the polarity of voltage applied to the liquid crystal for each pixel in the N field, FIG. 12 is a schematic explanatory diagram illustrating the polarity of voltage applied to the liquid crystal for each pixel in the N+1 field;

DETAILED DESCRIPTION OF THE PREFERRED EMBODIMENTS

Figure 1:
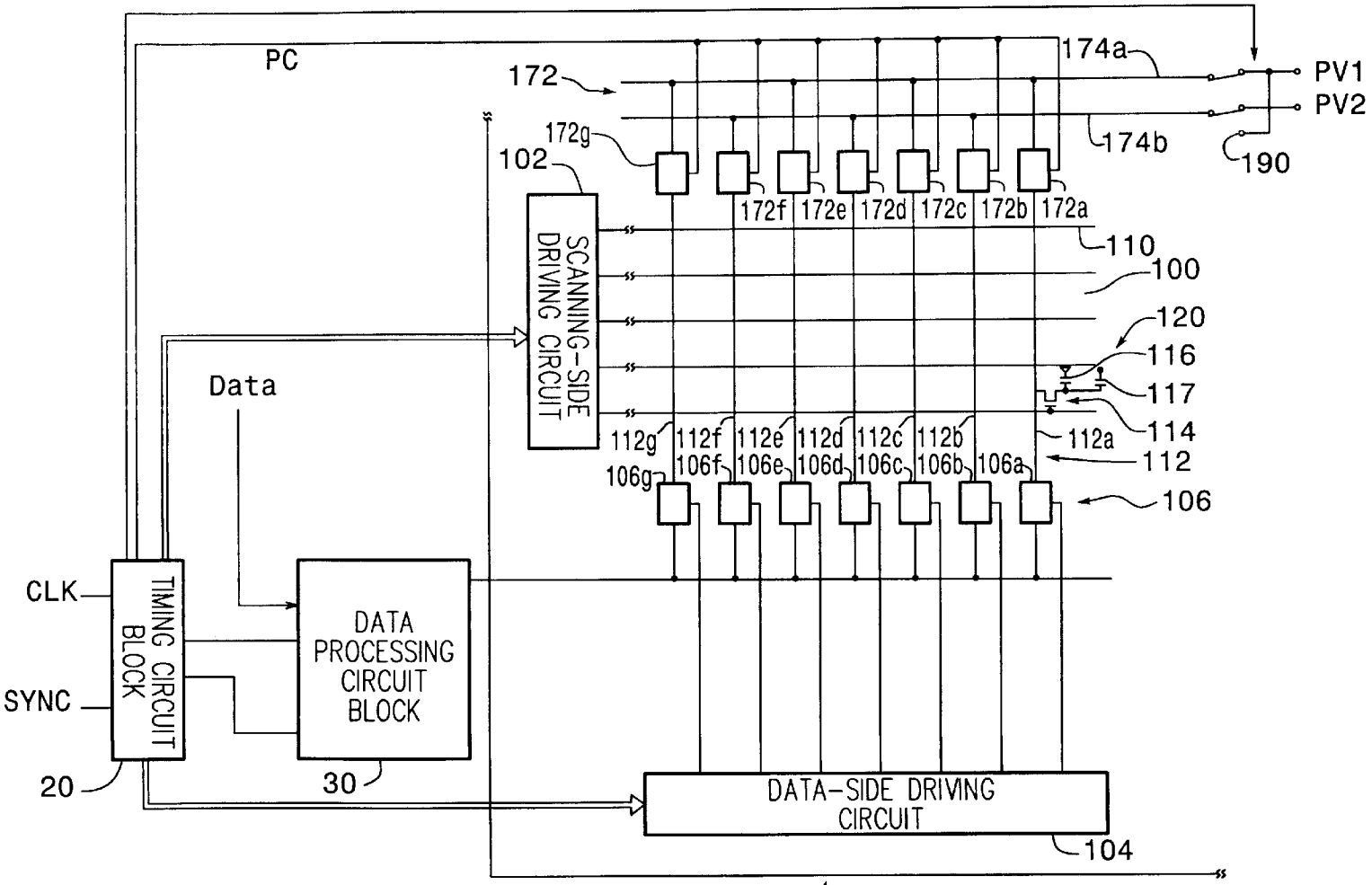
FIG. 1 is a schematic explanatory diagram of an active-matrix type liquid crystal apparatus according to the present invention.

FIG. 1 shows an overall schematic view of the liquid crystal apparatus according to the first embodiment. As shown in FIG. 1, this liquid crystal apparatus is a small-sized liquid crystal apparatus used as a light valve for electronic equipment such as a liquid crystal projector, and can be generally divided into the liquid crystal panel block 10, the timing circuit block 20, and the data processing block 30.

The timing circuit block 20 is for inputting clock signals CLK and synchronizing signals SYNC, and outputting shift start signals, shift clock signals pre-charging signals, and certain timing signals.

The data processing circuit block 30 is a circuit block which processes data by amplifying, inverting, etc., of the data so as to be appropriate for liquid crystal display. Incidentally, at this data processing circuit block 30, data signals corresponding with each pixel are subjected to polarity inversion per one pixel, with polarity inversion reference potential as a reference. Also, this polarity inversion is inverted for each vertical scanning period (each field or each frame).

The liquid crystal panel block 10 has liquid crystal sealed between a pair of substrates, has upon one of the substrates a pixel area 100, a scanning-side driving circuit 102, and a data-side driving circuit 104, and also has a common electrode on the other opposing substrate. The pair of liquid crystal panel substrates have a polarizing plate provided on the outer side thereof. Incidentally, the driving circuits may be separated from the liquid crystal panel substrates and comprise an external IC.

Formed on the pixel area 100 are a plurality of scanning signal lines 110 which extend in the row direction, for example, as shown in FIG. 1, and a plurality of data signal lines 112 which extend in the column direction, for example. Incidentally, with the present embodiment, a description will be given with the total number of scanning signal lines 110 as 492 lines, and with the total number of data signal lines 112 as 652 lines, but the number of scanning signal lines or data signal lines is not particularly restricted.

At each position at which the signal lines 110 and the data signal lines 112 cross, a switching element 114 and a pixel 120 are serially connected, thereby forming a display component. Each pixel 120 is comprised of pixel electrodes connected with the switching elements 114, these being formed together on one substrate, storage capacity 117 formed between the scanning signal lines and capacity lines neighboring each pixel electrode, a common electrode formed on the opposing other substrate, and a liquid crystal layer 116 sandwiched between both electrodes.

The period in which the switching elements 114 of each pixel 120 are on is referred to as "selected period", and period in which each are OFF is referred to as "non-selected period". The storage capacity 117, during the non-selected period, storing voltage sampled via the switching element 114 during the selected period, is connected to the pixel 120.

According to the present embodiment, a three-terminal type switching element is used for the switching element 114, such as a TFT (thin-film transistor). The switching element is not restricted to such, and a MOS transistor which is another type of three-terminal type switching element, or a two-terminal type switching element such as a MIM (metal-insulator-metal) element or a MIS ((metal-insulator-semiconductor) element may be used. Incidentally, the pixel area 100 in the present embodiment is not restricted to an active-matrix type liquid crystal display panel using two-terminal or three-terminal type switching elements; rather, various types of liquid crystal panels such as passive-matrix type liquid crystal panels, may be used.

The scanning-side driving circuit 102 is for outputting a scanning signal in which a selected period for sequentially selecting at least one scanning signal line 110 out of the plurality of scanning signal lines 110 is set.

The data-side driving circuit 104 is for outputting sampling signals for performing point-at-a-time driving of the pixel area 100, to the sampling switches 106 each positioned between the data signal lines 112*a*, 112*b*, and so forth, of the pixel area 100. Incidentally, in the event that the data processing circuit block 30 has a conventional phase expanding circuit, the output lines of the data processing circuit block 30 is the same number of output lines as the phase expanding number thereof. Now, a phase expanding circuit samples and holds image data signals as serial data according to a sampling period, which is set according to a reference clock, and expands the serial data at certain pixel intervals and outputs in parallel a plurality of data signals, which have had the one data period converted to an integer multiple of the reference clock, from the data processing circuit block 30.

The pre-charging switches 172*a*, 172*b*, and so forth are turned ON at a certain time according to a pre-charge signal, and a first (negative polarity) pre-charge power supplying line 174*a* or a second (positive polarity) pre-charge power supplying line 174*b* is connected to each of the data signal lines 112*a*, 112*b*, and so forth, thereby pre-charging the data signal lines 112. The polarity of the pre-charging power voltage is a polarity with the common electrode potential applied to the common electrode as a reference.

The first pre-charging potential PV1 and the second pre-charging potential PV2 are switched each time a scanning signal line 110 is selected (each horizontal scan) and supplied to the first and second pre-charging switches 174*a* and 174*b*, via a pre-charging power supply switch 190. Incidentally, the switching time of the pre-charging power supply switch 190 is set so as to be switched at least before the pre-charging switch 172 comes on.

According to the present embodiment, polarity inversion driving is conducted, so during odd-numbered horizontal scanning periods for example, the odd numbered data signal lines 172*a,* 172*c,* and so forth are connected to the first pre-charging power supply line 174*a,* and the even numbered data signal lines 172*b,* 172*d,* and so forth are connected to the second-pre-charging power supply line 174*b.* Also, during even-numbered horizontal scanning periods for example, the odd numbered data signal lines 172*a,* 172*c,* and so forth are connected to the second pre-charging power supply line 174*b,* and the even numbered data signal lines 172*b,* 172*d,* and so forth are connected to the first pre-charging power supply line 174*a.* The details of this pre-charging operation will be described later.

That is to say, according to the present embodiment, polarity inversion driving is performed for each pixel in the direction in which the scanning signal lines extend, and polarity inversion driving is performed for each line (each scanning signal line) in the direction in which the data signal lines extend, and polarity inversion timing is set to match this. That is to say, the polarity of the pre-charging potential to be applied to each data signal line and each pixel is inverted not only for each scanning signal line or each pixel, but also is inverted for each vertical scanning period. Incidentally, a case in which pre-charging charging is required is a case of which polarity inversion driving is performed at least for each line, but is not restricted to polarity inversion per pixel.

Then, the shift start signal formed based on the clock CLK and synchronizing signal SYNC is input to the shift register of the data-side driving circuit 104, and the data-side driving circuit 104 generates a sampling signal. Based on this sampling signal, the sampling switches 106*a* through 106*g* are sequentially turned ON, thereby performing sampling of data signals.

According to the first embodiment, during the blanking period (retracing period) before the sampling periods for each data signal line as described above, each data signal line is simultaneously pre-charged with the same polarity as the polarity of the voltage being applied to the pixels based on the data signals sampled during the above sampling period. Incidentally, the polarity of the voltage applied to the pixels based on the data signals is a polarity which holds to the common elected potential as a reference.

Figure 2:
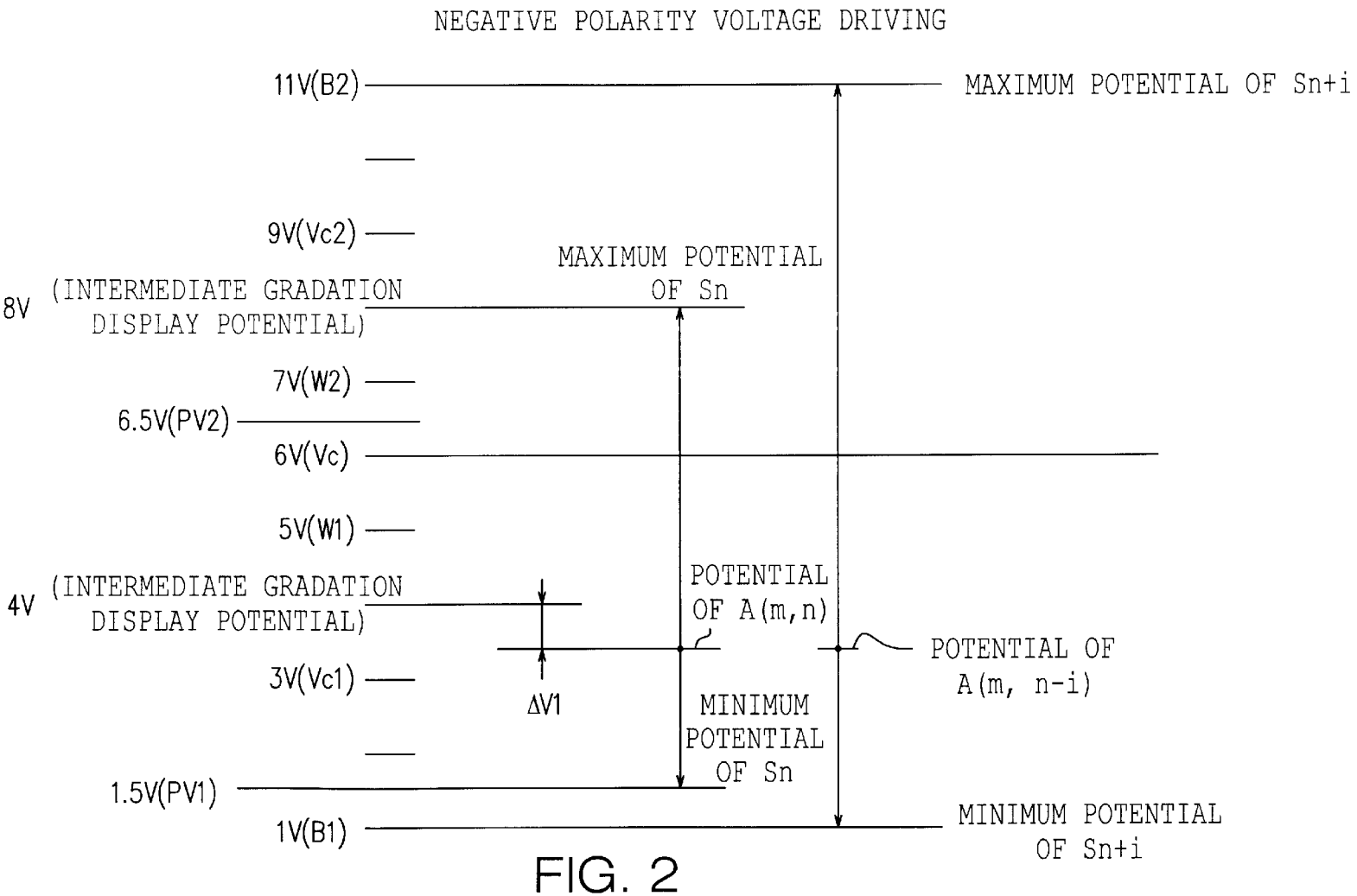
FIG. 2 is a schematic explanatory diagram illustrating the potential of a pixel at the time that the liquid crystal is driven by negative polarity voltage, and the polarity of the data signal line to which leakage occurs, according to a first embodiment of the present invention.

Description will be made regarding the relationship between this pre-charging potential and the data signal potential, with reference to FIG. 2. FIG. 2 illustrates the data signal potential and pre-charging potential in the event of using an N-channel TFT for the switching element 114 and also performing normally-white display. In FIG. 2, in the event that the liquid crystal is to be driven at negative polarity voltage, the data signal potential changes between the first potential B1 (1V) and second potential W1 (5V), according to the gray scale value. With a normally-white display, the first potential B1 corresponds with black display, and the second potential W1 corresponds with white display. Incidentally, in the case of a normally-black display, the relationship mentioned above is opposite.

In FIG. 2, in the event of driving the liquid crystal at positive polarity, the data signal potential changes between the third potential B2 (7V) and fourth potential W2 (11V), according to the gray scale value. With a normally-white display, the second potential W2 corresponds with white display, and the fourth potential B2 corresponds with black display. Incidentally, in the case of a normally-black display, the relationship mentioned above is opposite.

Accordingly, the amplitude center Vc of this data signal potential is 6V. Also, in the event of negative polarity voltage driving, the center potential VC1 of the amplitude (B1 through W1) is 3V, and in the event of positive polarity voltage driving, the center potential VC2 of the amplitude (B2 through W2) is 9V.

Figure 16:
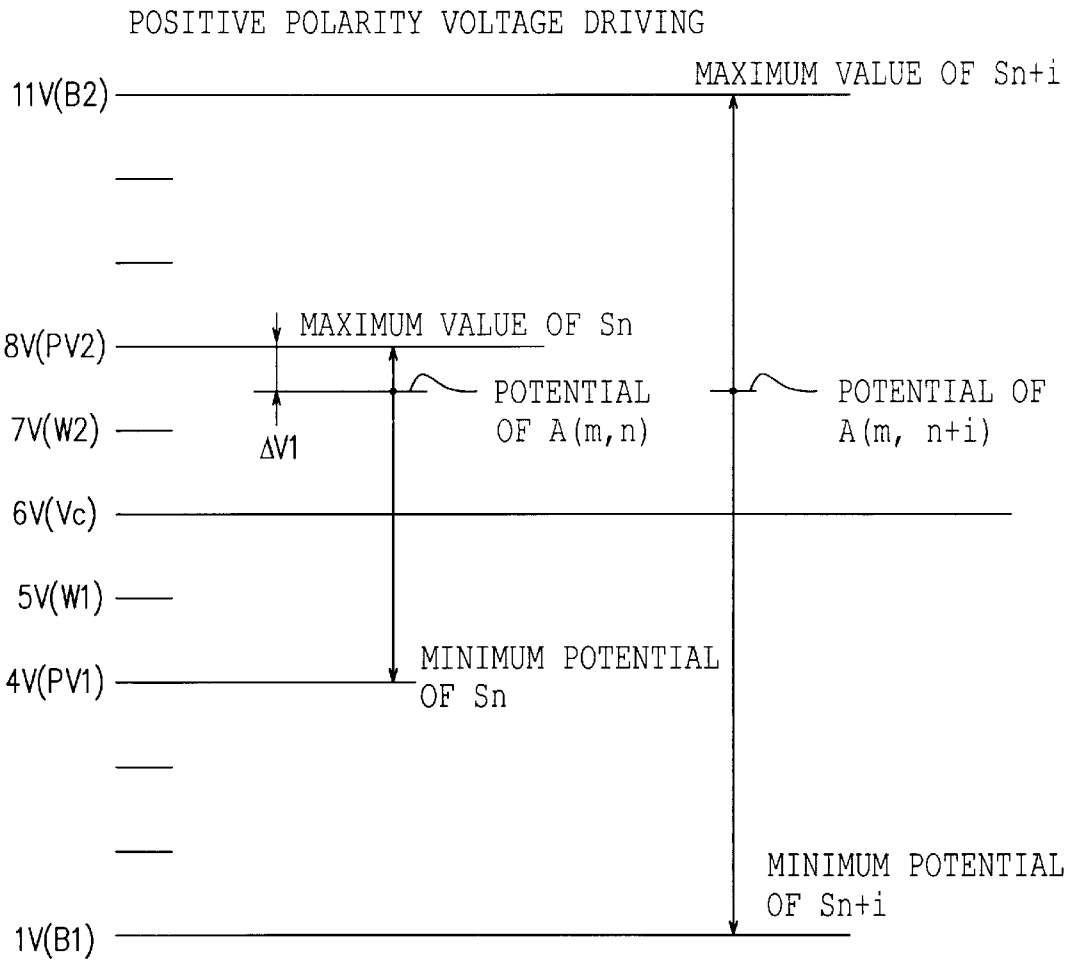
FIG. 16 is a schematic explanatory diagram illustrating the potential of a pixel at the time that the liquid crystal is driven by negative polarity voltage, and the potential of the data signal line to which leakage occurs, according to a conventional example.
Figure 17:
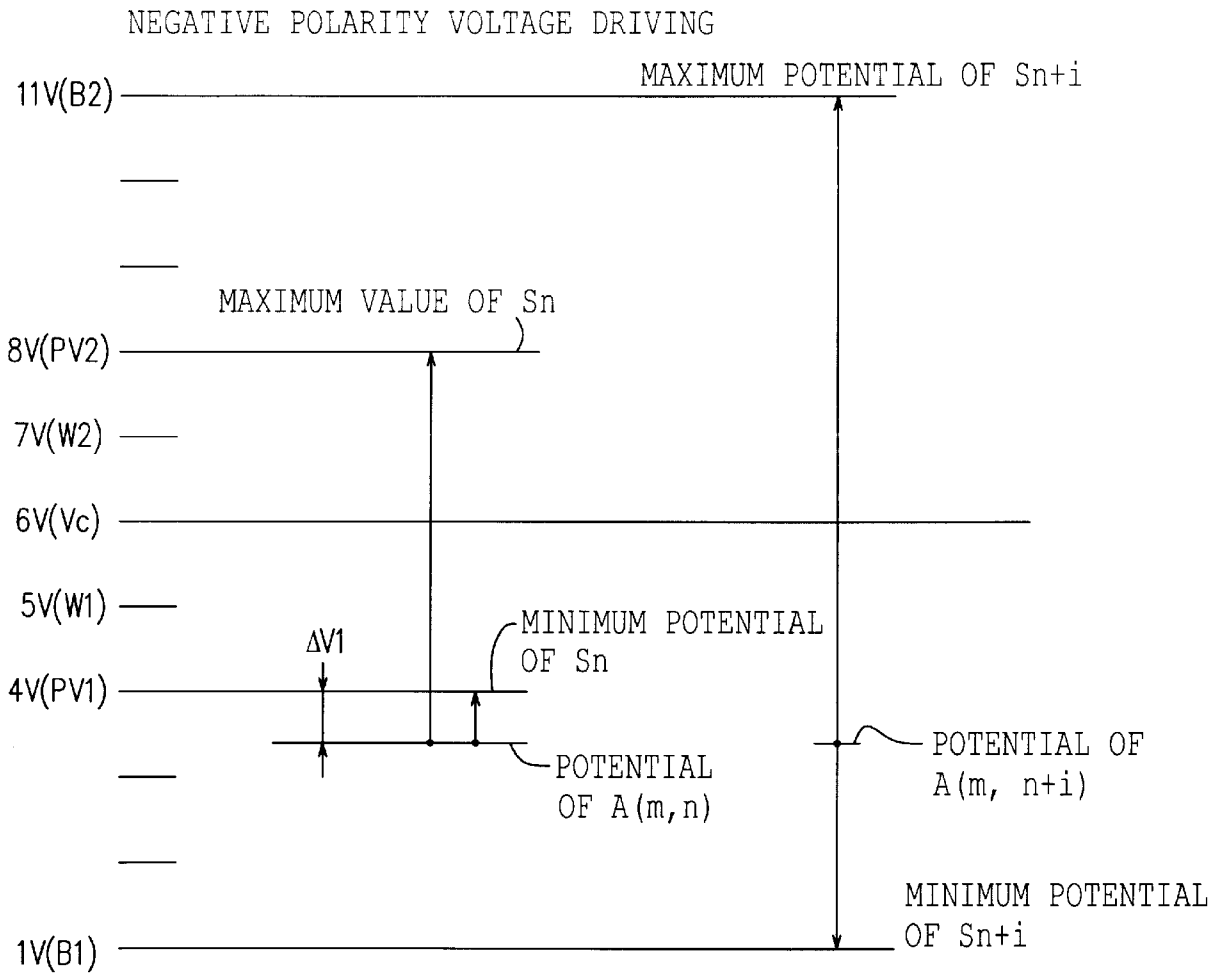
FIG. 17 is a schematic explanatory diagram illustrating the potential of a pixel at the time at the liquid crystal is driven by positive polarity voltage, and the potential of the data signal line to which leakage occurs, according to a conventional example.
Figure 18:
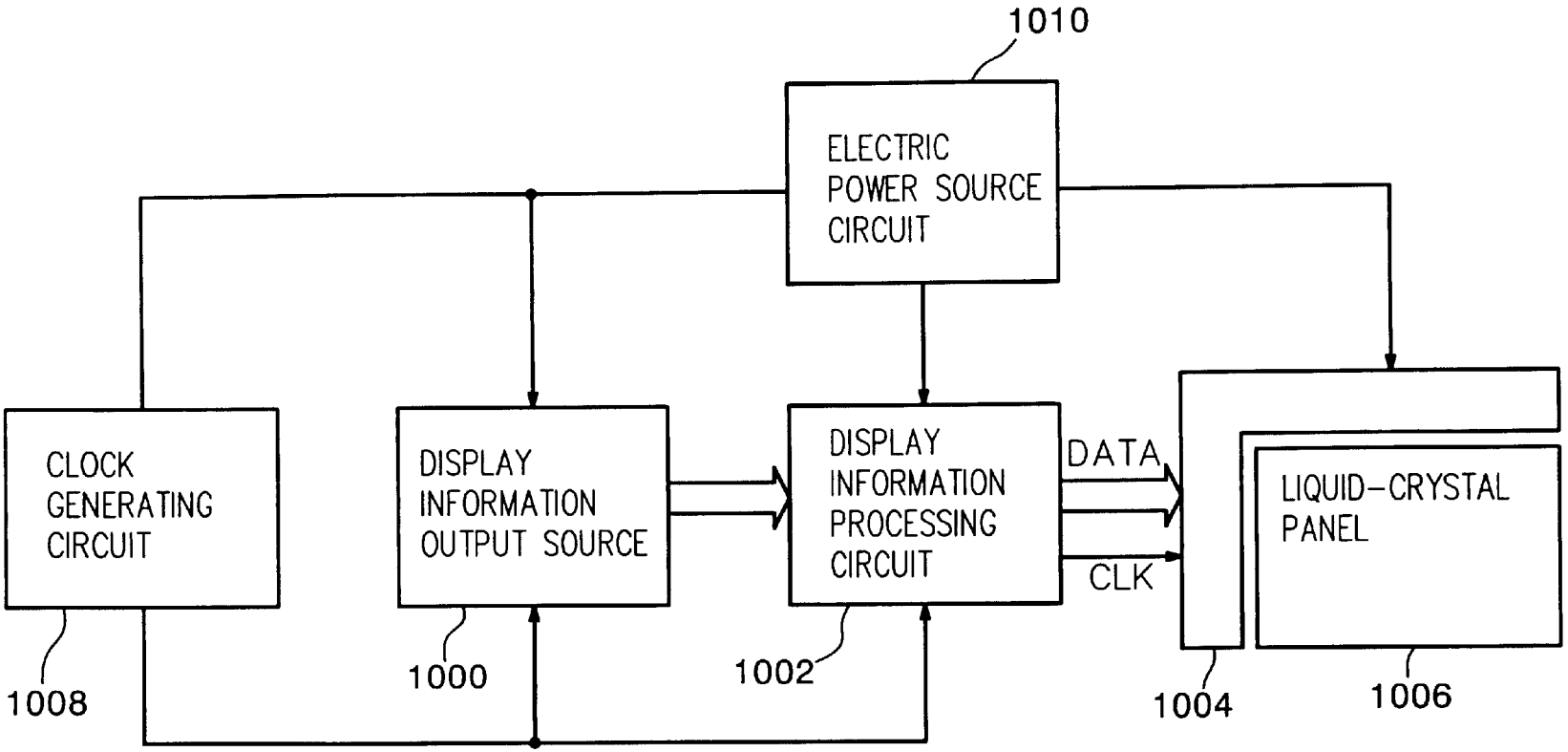
FIG. 18 is a schematic diagram illustrating an electronic equipment comprised using the image diagram device according to the present invention.

The above relation is the same as the case of FIG. 16 and FIG. 17, but with the present embodiment, the first pre-charging potential PV1 and the second pre-charging potential PV2 are different from conventional arrangements.

In the present embodiment, the first pre-charging potential PV1 is set at 1.5V, and the second pre-charging potential PV2 is set at 6.5V. In this way, the first and second pre-charging potentials PV1 and PV2 are set so as to be non-symmetrical relative to the amplitude center Vc of the data signal potential.

Further, with the present embodiment, the first pre-charging potential PV1 (1.5V) is set so as to be closer to the first potential (1V) than the amplitude center VC1 (3V) of the data signal potential in the negative polarity voltage driving. The second pre-charging potential PV2 (6.5V) is set so as to be of a smaller value than the third potential W2 (7V) of the positive polarity voltage driving.

Figure 15:
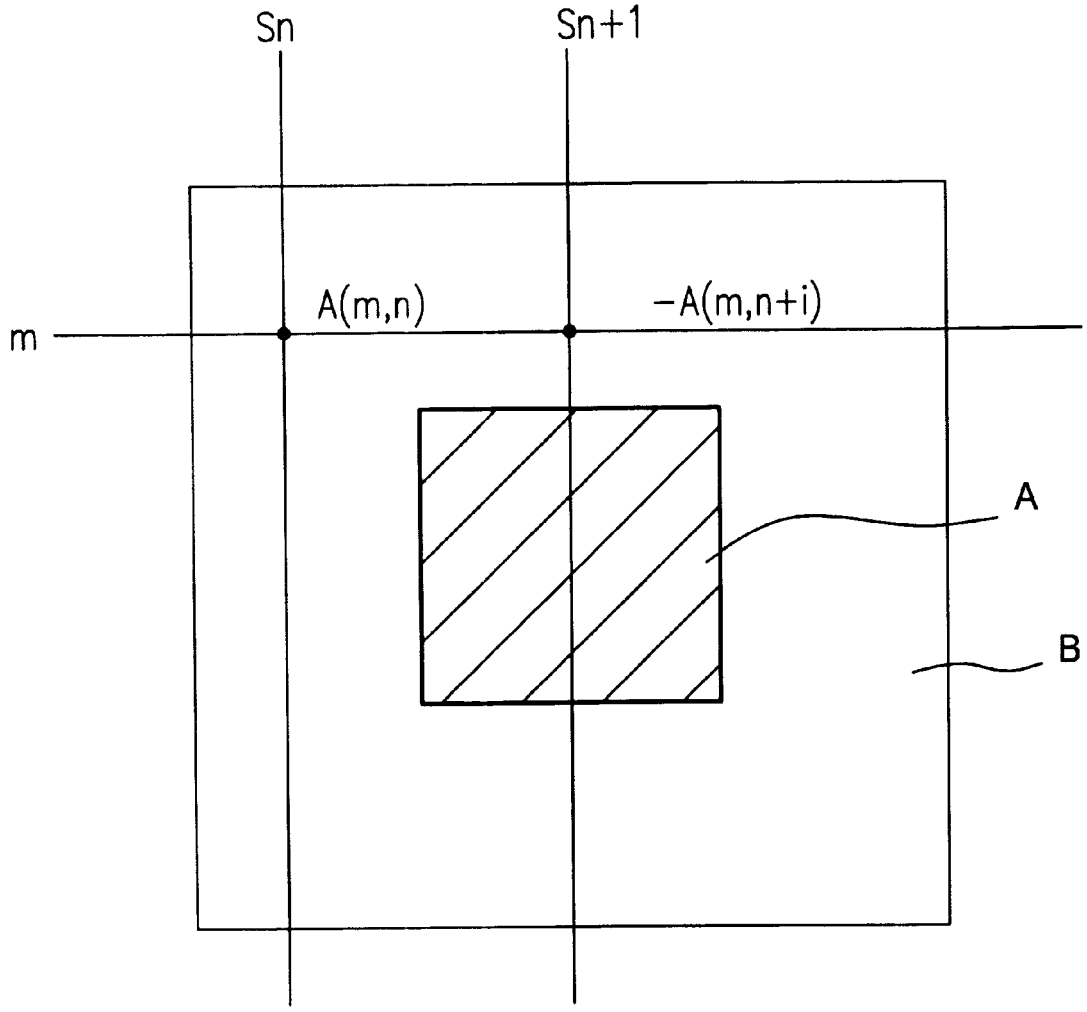
FIG. 15 is a model diagram illustrating a liquid crystal screen, which is provided in order to describe optical cross-talk.

Now, description will be made regarding a case wherein the liquid crystal of the pixel A(m, n) and pixel A(m, n+i) shown in FIG. 15 are to be driven by voltage of a negative polarity, and wherein voltage (4V) for intermediate gray scale display is to be applied to one end of the pixel. In this case, as shown in FIG. 2, a voltage which has fallen from 4V by ΔV1 is charged to the pixel. The reason for this will be described with reference to FIG. 4.

Figure 4:
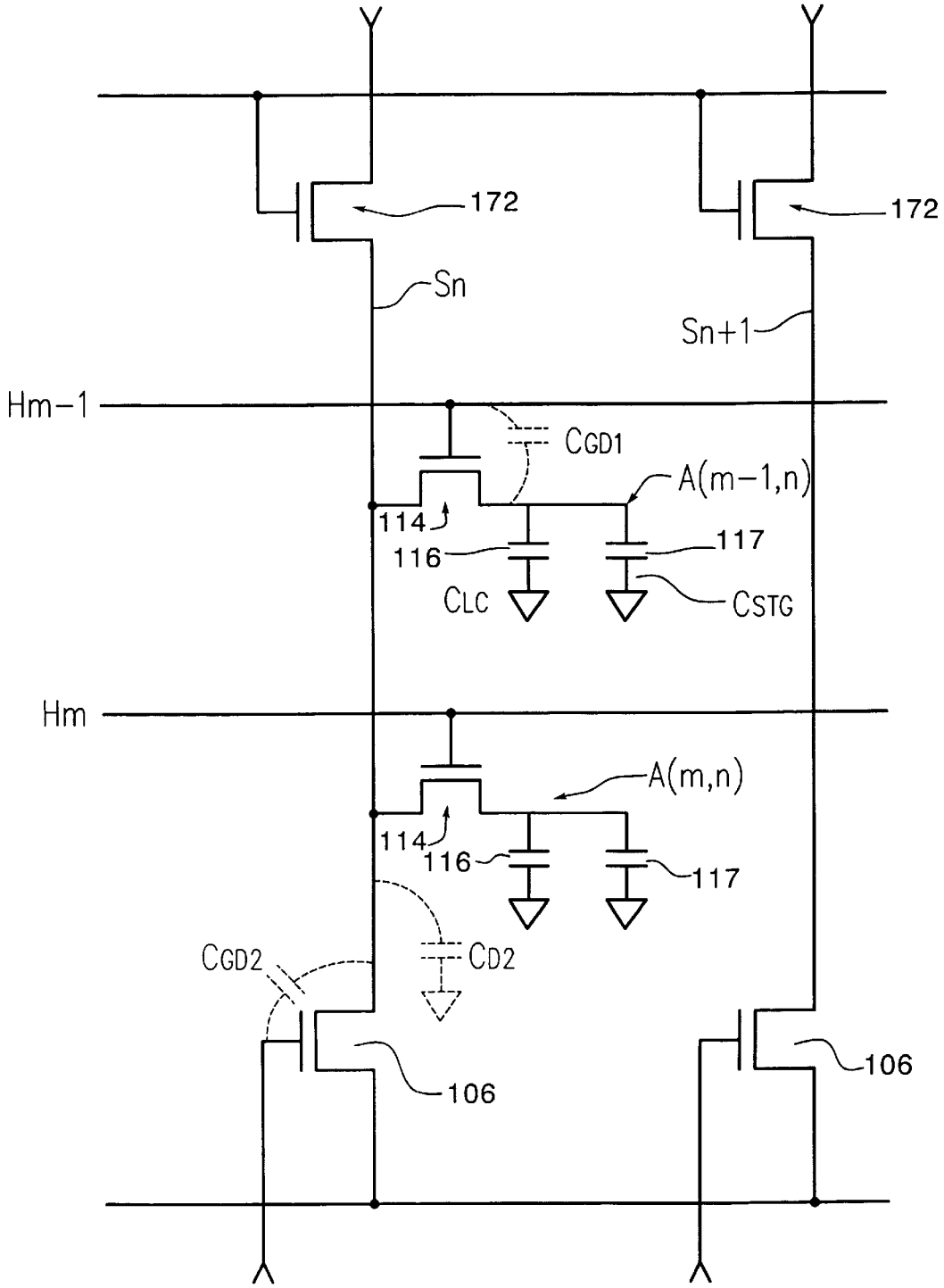
FIG. 4 is a schematic explanatory diagram illustrating a model of pixel A(m−1, n) and pixel A(m, n)

In FIG. 4, the capacity between the gate/drain of the switching element (TFT) 114 is referred to as CGD1, the capacity of the liquid crystal layer 116 as CLC, the storage capacity 117 as CSTG, and the potential difference in the scanning signals applied to the gate of the TFT 114 between the selected period and the non-selected period as Vg. Immediately following applying of the charging voltage to the pixel in the selected period, a voltage fall ΔV1 occurs owing to the parasitic capacity of the TFT 114. The ΔV1 is approximated as follows:

$$\Delta V1=[CGD1/(CGD+CCL+CSTG)]\times Vg$$

That is to say, at the point that the scanning signal becomes the non-selected potential in the non-selected period, the charge stored in the CGD during the selected period flows into CLC and CSTG, thus dropping the storage voltage of CLC and CSTG.

Also, there is a voltage fall ΔV2 owing to parasitic capacity between the gate/drain of the sampling switch (TFT) 106. With the parasitic capacity between the gate/drain of the sampling switch (TFT) 106, which is referred as CGD2, parasitic capacity of the data signal line as CD2, and the potential difference in the sampling signal applied to the gate of the TFT 106 between the sampling period and non-sampling period as Vg2, the voltage fall ΔV2 can be approximated as follows:

$$\Delta V2=[CGD2/(CGD2+CD2)]\times Vg2$$

Accordingly, a voltage fall of ΔV approximated by adding ΔV1 and ΔV2 occurs between the data signal potential before sampling and the potential actually applied to the liquid crystal layer of the pixel.

Figure 3:
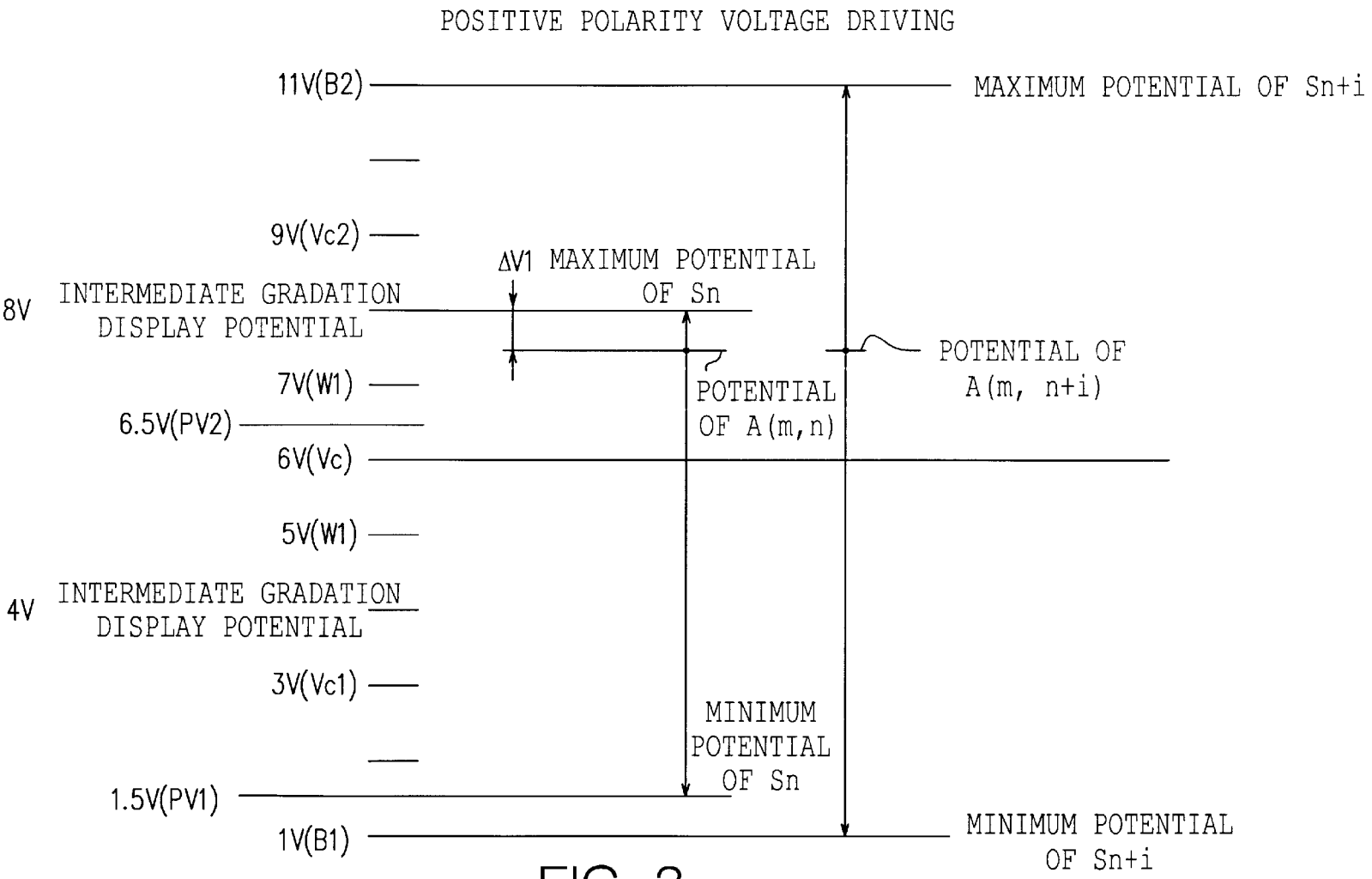
FIG. 3 is a schematic explanatory diagram illustrating the potential of a pixel at the time that the liquid crystal is driven by positive polarity voltage, and the polarity of the data signal line to which leakage occurs, according to the first embodiment of the present invention.

Now, with the pixel A(m, n) shown in FIG. 15, since the intermediate gray scale display is performed by all pixels connected to the data signal line Sn, so during the pre-charging period prior to the negative polarity voltage driving, the data line Sn is pre-charged to the first pre-charging potential PV (1.5V). This is the point in which FIG. 2 differs from the conventional arrangement in FIG. 17. With the conventional method shown in FIG. 17, the charging voltage of the pixel A(m, n) shifts only in the positive direction by means of the leak occurring at the TFT, but in the case of FIG. 2, a potential higher than the charging voltage and a potential lower than the charging voltage are alternately applied to the data signal line, so the charge voltage fluctuates so as to shift in both of the positive and negative directions, alternatively. At the point that the charge voltage fluctuates so as to shift alternatively in both directions, pixel A(m, n) and pixel A(m, n+i) become the same. Accordingly, when the pixel A(m, n+i) shifts in the direction to become black on the display, the pixel A(m, n) also shifts in the direction to become black on the display, and the effects of optical cross-talk are offset on the display. In the same manner, when the pixel A(m, n+i) shifts in the direction to become white on the display, the pixel A(m, n) also shifts in the direction to become white on the display, and the effects of optical cross-talk are offset on the display. Thus, according to the present embodiment, optical cross-talk can be made unnoticeable on the display, improving image quality. Incidentally, in the event of driving the liquid crystal layer with positive polarity voltage, the arrangement is as shown in FIG. 3 and there is no problem, the same as the conventional arrangement. Also, the operation of the second pre-charging potential PV2 will be described later.

Next, a description will be given regarding the overall operation of pre-charging whereby undesirable effects owing to switching nose at the sampling switches has been reduced.

Figure 5:
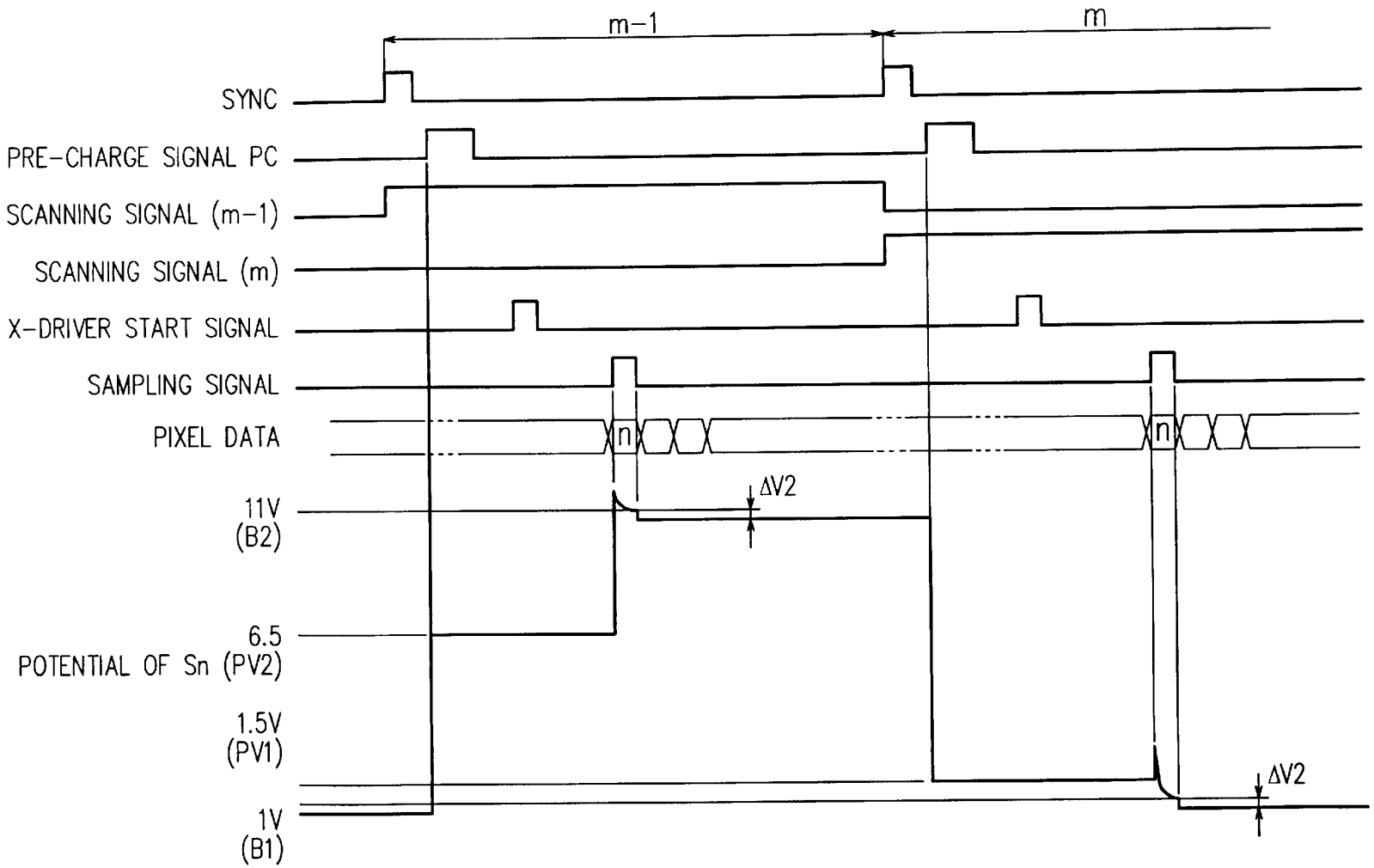
FIG. 5 is a timing chart illustrating the change in potential of the data signal line Sn connected to the pixel A(m−1, n) and pixel A(m, n) shown in FIG. 4.

FIG. 5 shows a timing chart of the liquid crystal apparatus according to the present invention in the case that all of the sampling switches 106 shown in FIG. 1 and all of the switching elements 114 are formed on N-channel transistors. Here, FIG. 5 describes displaying of black with both the pixel 120 of the pixel A(m, n) shown in FIG. 4 and the pixel 120 of the pixel A(m, n) shown in FIG. 4, and describes the change in potential at the data signal line therein.

Also, FIG. 5 gives a description on the assumption that the data signal line Sn is pre-charged by positive polarity potential during the period in which the pre-charge signal PC in the m−1horizontal scanning period is set to "high", and that the data signal line Sn is pre-charged by negative polarity potential during the period in which the pre-charge signal PC in the m'th horizontal scanning period is set to "high".

In the present embodiment, as described above, the first pre-charge potential PV1 is set to, e.g., 1.5V, and the second pre-charge potential PV2 is set to, e.g., 6.5V.

The horizontal scanning signal (m−1) is set to "high" by means of the m−1 horizontal synchronizing signal SYNC being input. Accordingly, all switching elements 114 connected to the scanning signal line Hm−1 turn ON. Subsequently, the pre-charging signal PC turns "high", and all of the pre-charging switches 172 go ON. Accordingly, the first pre-charging potential PV1 (1.5V) from the first pre-charging power source 174*a* is supplied to the odd-numbered data signal lines S1, S3, . . . , Sn−1, Sn+i, Sn+3, and so forth. On the other hand, the second pre-charging potential PV2 (6.5V) from the second pre-charging power source 174*b* is supplied to the even-numbered data signal lines S2, S4, . . . , Sn, Sn+2, Sn+6, and so forth.

Now, in the event that a black display had been performed by the pixel A(m−2, n) prior to this pre-charging operation, the potential of the data signal line Sn shown in FIG. 5 is close to the black level potential B1 (1V). Subsequently, since the above pre-charging operation is started, the data signal line Sn is pre-charged to the second pre-charging potential PV2 (6.5V). Also, since the data signal line Sn has the parasitic capacity CD2, the data signal line Sn maintains the second pre-charging potential PV2 even after the pre-charging period ends.

Then, further, data signal sampling against all of the pixels connected to the scanning signal line Hm−1 shown in FIG. 4, is started. In the event that the total number of the data signal lines 112 is 652, the sampling of the data signal is performed by point-at-a-time sampling in which data signal are sampled, for example from the left end of the data signal line and sequentially per data signal line according to the sampling signals. Then, in order to display the pixel A(m−1, n) black, the positive polarity side black level potential B2 (11V) is supplied to the data signal line throughout the sampling period, via the sampling switch 106. Then, the storage capacity 117 and liquid crystal layer 116 of the pixel A(m−1, n) is charged with a charge, thereby performing black display.

At this time, as shown in the timing chart of FIG. 5, switching noise occurs at the time of turning the sampling switch 106 ON, at the leading edge of the sampling signal, and the switching noise is superimposed on the data signal line Sn. This switching noise which occurs when turning the sampling switch 106 ON acts toward the direction of temporarily increasing the potential of the data signal line Sn.

In this way, in the event that a N-channel transistor is used for the sampling switch 106, the switching noise operates in the direction of speeding up the charging when charging up the data signal line Sn from the second pre-charging potential PV2 to the data signal potential. Accordingly, even if this second pre-charging potential PV2 is set at 6.5V which is lower than the 8V in conventional arrangements, the situation in which the data signal line Sn is not charged to the original data signal potential before the sampling period is completed is decreased.

At the trailing edge of this sampling signal, the sampling switch 106 is turned OFF, but at this time the aforementioned voltage fall ΔV2 is generated owing to the parasitic capacity of the sampling switch 106, and the potential of the data signal line Sn drops as shown in FIG. 5. Accordingly, the voltage charged to the pixel A (m−1, n) becomes a low voltage based on the above-described falling voltage ΔV1, as compared with the original data signal potential. Further, the above-described falling voltage ΔV2 occurs in the pixel as well. However, the voltage necessary for black display at each pixel can be applied to the liquid crystal layer of the pixel by taking into consideration of these falling voltage and then setting the common electrode potential which is to be applied to the common electrode formed on the opposing substrate at a lower value beforehand.

Incidentally, constructing the sampling switch 106 with a CMOS transistor structure can prevent such voltage drops.

Subsequently, the horizontal scanning signal (m−1) enters the "low" state, and the horizontal scanning signal (m) enters the "high" state. The scanning signal line Hm shown in FIG. 4 is selected, and all switching elements 114 connected to this horizontal scanning line Hm are turned ON.

Then, following this, the pre-charging operation and the data writing operation are executed in the same manner as with the scanning signal line Hm−1. However, it should be noted that the pre-charging operation and the data writing operation during the m'th horizontal scanning period are both executed at negative polarity voltage. Accordingly, the switch 190 shown in FIG. 1 is switched over before the pre-charging operation. Consequently, the second pre-charging potential PV2 (6.5V) from the second pre-charging power source 174*b* is applied to the odd-numbered signal lines S1, S3, . . . , Sn−1, Sn+i Sn+3, and so forth. On the other hand, the first pre-charging potential PV2 (1.5V) from the first pre-charging power source 174*a* is applied to the even-numbered signal lines S2, S4, . . . , Sn, Sn+2, Sn+4, and so forth.

Let us now discuss the potential of the data signal line Sn during this m'th horizontal scanning period. The potential of the data signal line Sn is pre-charged from a potential for performing a black display on pixel A(m−1, n) to a first pre-charging potential PV1 (1.5V). Subsequently, as shown in the timing chart of FIG. 5, at the time of turning ON the sampling switch 106 at the leading edge of the sampling signal, switching noise is generated, and this is superimposed on the data signal line Sn. The switching noise generated when turning the sampling switch 106 ON operates in the direction of temporarily increasing the potential of the data signal line Sn, and operates in the opposite direction to discharging the potential of the data signal line Sn to black level potential B1 (1V) by pre-charging.

Accordingly, in the m'th horizontal scanning period, the above switching noise operates to delay the operation of discharging the potential of the data signal line Sn until it reaches the black level potential B1. However, by means of setting the first pre-charging potential PV 1 at 1.5V, there is a 0.5V difference with the black level potential B1 (1.5V), so the data signal line Sn can be made to reach the black level potential B1 during the sampling period.

In this way, in the event that the sampling switch 106 is an N-channel transistor, the switching noise has undesirable effects on discharging the data signal line Sn. The harshest conditions for discharging the data signal line Sn are when setting the data signal line Sn to the black level potential B1 (1V). Accordingly, with the present embodiment, the first pre-charging potential PV1 is set to 1.5V which is close to the black level potential B1 (1V). Incidentally, in the event that the first pre-charging potential PV1 is lower than the black level potential B1, the gate potential and source potential of the sampling switch 106 become equal and there is the danger of leaking. Accordingly, it is preferable to set the first pre-charging potential PV1 so as to be higher than the black level potential B1, with taking into consideration about the irregularities of the circuit constant, and further so as to be as close to the black level potential B1 as possible.

Also, the second pre-charging potential PV2 is set at 6.5V in the present embodiment, which is lower than the white level potential W2 (7V) at the time of positive polarity voltage driving. One reason is that during the m'th horizontal scanning period shown in FIG. 5, by means of constantly charging the data signal line Sn with this 6.5V second pre-charging potential PV2, the data signal line Sn can be set to any data signal potential between white level potential W2 (7V) and black level potential B2 (11V). At this time, the switching noise at the time of initiating the sampling period operates to speed up the charging. Accordingly, even if the second pre-charging potential PV2 is not set to 8V as with conventional arrangements, the data signal line Sn can be charged up to the original data signal potential within the sampling period even with the present embodiment.

Regarding setting of this second pre-charging potential PV2, various value settings can be made as long as 4V or more, which is the potential difference between the conventional first and second pre-charging potentials PV1 and PV2, can be secured for the potential difference between the first and second pre-charging potentials PV1 and PV2 according to the present embodiment. That is because the potential difference within the data signal potential range from the second pre-charging potential to the positive polarity data voltage amplitude (W2 through B2) can be kept within a potential difference which can be charged or discharged within the sampling period. Particularly, in the case of phase expanding of the image data as described above, each data signal line can be charged or discharged until reaching the data signal potential, even if there is a certain amount of irregularities in the sampling period for sampling each piece of image data. Consequently, generation of vertical stripes in the image owing to the irregularities of the sampling period can be reduced.

Incidentally, as described above, during the m'th horizontal scanning period, the above-described falling voltage ΔV1 occurs at the time of sampling switch 172 comes on, and so the potential of the data signal line Sn becomes a voltage lower that the black level potential B1 as shown in FIG. 5.

Figure 6:
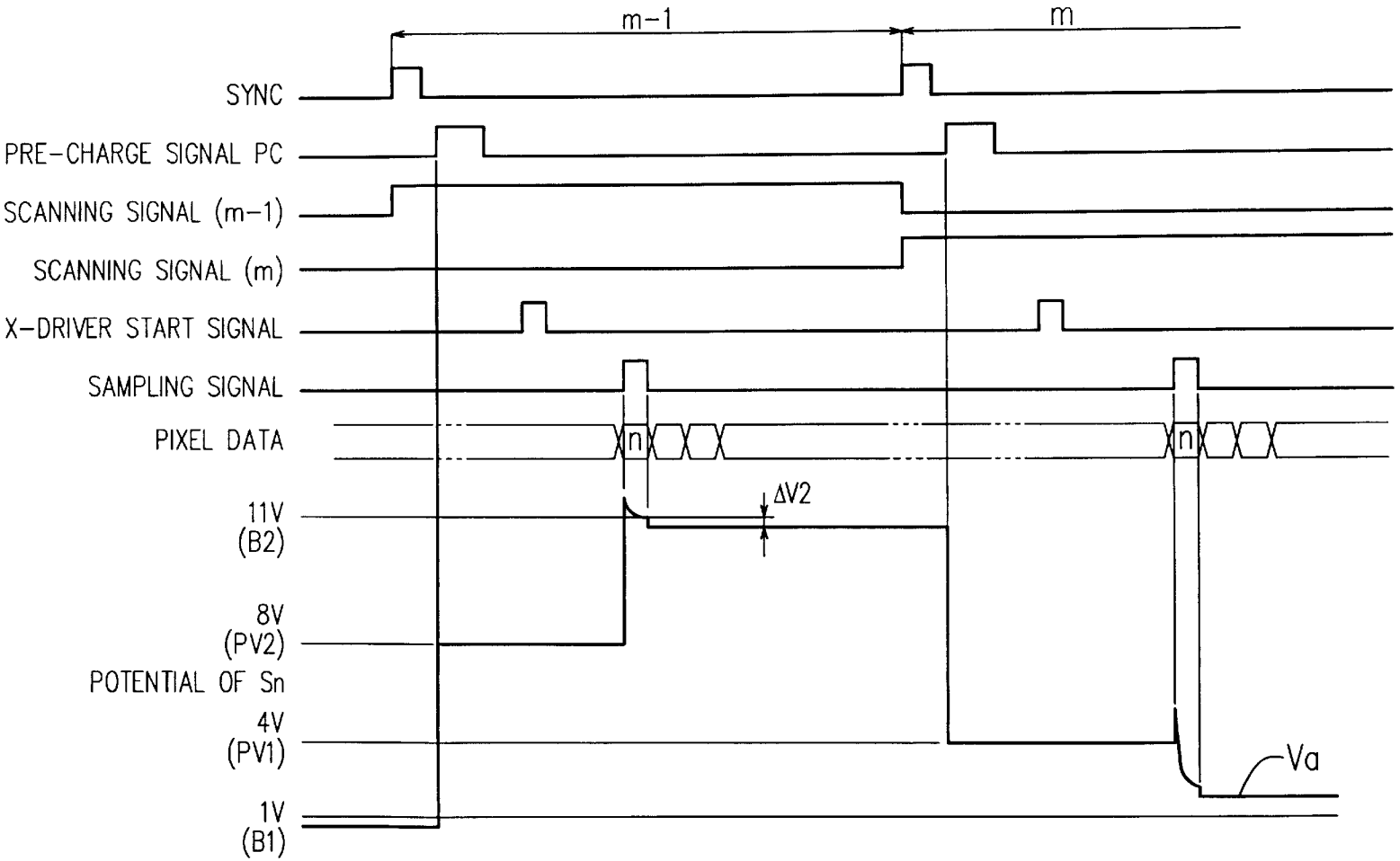
FIG. 6 is a timing chart of a comparative example 1 wherein the pre-charge potential in FIG. 5 has been changed.

FIG. 6 shows a timing chart of a comparative example 1 wherein the first and second pre-charging potentials PV1 and PV2 shown in FIG. 5 are respectively set to the conventional levels of 4V and 8V. During the m'th horizontal scanning period shown in FIG. 6, undesirable effects of the switching noise cause the sampling period to end before the potential of the data signal line Sn is discharged from the first pre-charging potential PV1 (4V) to the black level potential B1. Accordingly, the potential of the data signal line Sn becomes a potential Va which is not the data signal potential corresponding with the original black, and it can be understood that the pixel A(m, n) is charged with a charge which does not reflect the original data and thus, image quality deteriorates.

Next, description will be made regarding a second embodiment wherein the switching elements 114 or sampling switches 106 shown in FIG. 1 and FIG. 4 are formed of P-channel type transistors.

First, the method for reducing image quality deterioration owing to optical cross-talk in the event that the switching element 114 is a P-channel transistor will be described.

In this case, the first pre-charging potential PV1 is set to be 5.5V, and the second pre-charging potential PV2 is set to be 10.5V. In this way, the first and second pre-charging potentials are set so as to be non-symmetrical to the amplitude center Vc of the data signal potential.

Further, according to the present embodiment, the second pre-charging potential PV2 is set so as to be closer to the second potential (11V) than the amplitude center VC2 (9V) of the data signal potential in the positive polarity voltage driving. The first pre-charging potential PV1 is set so as to be of a greater value than the second potential W1 (5V) in negative polarity voltage driving.

Figure 7:
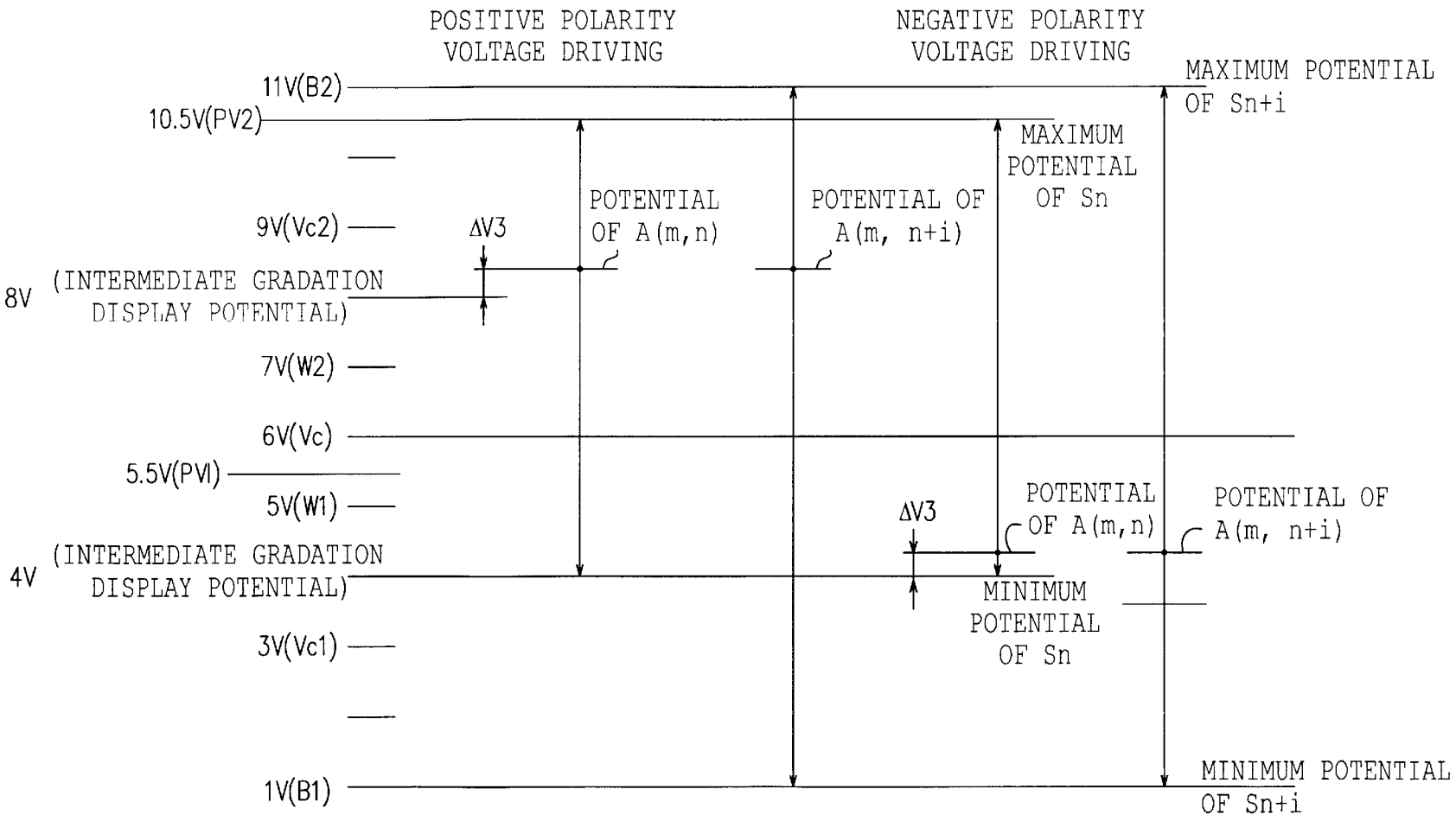
FIG. 7 is a schematic explanatory diagram illustrating the potential of a pixel at the time that the liquid crystal is reactively driven by negative polarity and positive polarity voltage, and the polarity of the data signal line to which leakage occurs, according to a second embodiment of the present invention.
Figure 14:
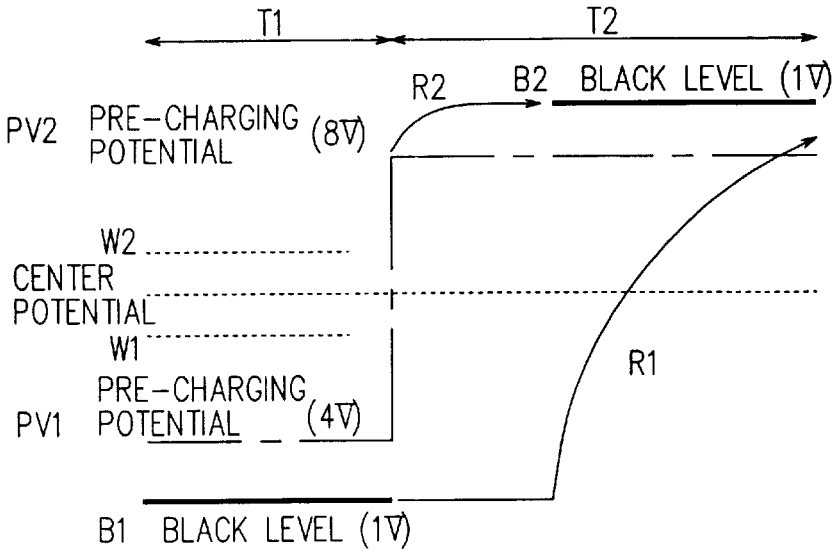
FIG. 14 is a properties diagram illustrating the change in potential of the data signal line when writing the same black data to both of the two pixels shown in FIG. 13.

Now, a description will be given regarding a case wherein the liquid crystal of the pixel A(m, n) and pixel A(m, n+i) shown in FIG. 14 are to be driven by voltage of a positive polarity, and wherein voltage (8V) for intermediate gray scale display is to be applied to one end of the pixel. In this case, unlike the case in which an N-channel transistor is used, when forming a switching element with the P-channel transistor switching element, a voltage which has risen by ΔV3 from 8V is charged to the liquid crystal layer, as shown in FIG. 7. The voltage which has risen by ΔV3 is obtained in the same manner as with the aforementioned formula which was used for calculating the falling voltage ΔV1 using a N-channel transistor instead of a P-channel transistor as the switching element 114*a*.

Figure 8:
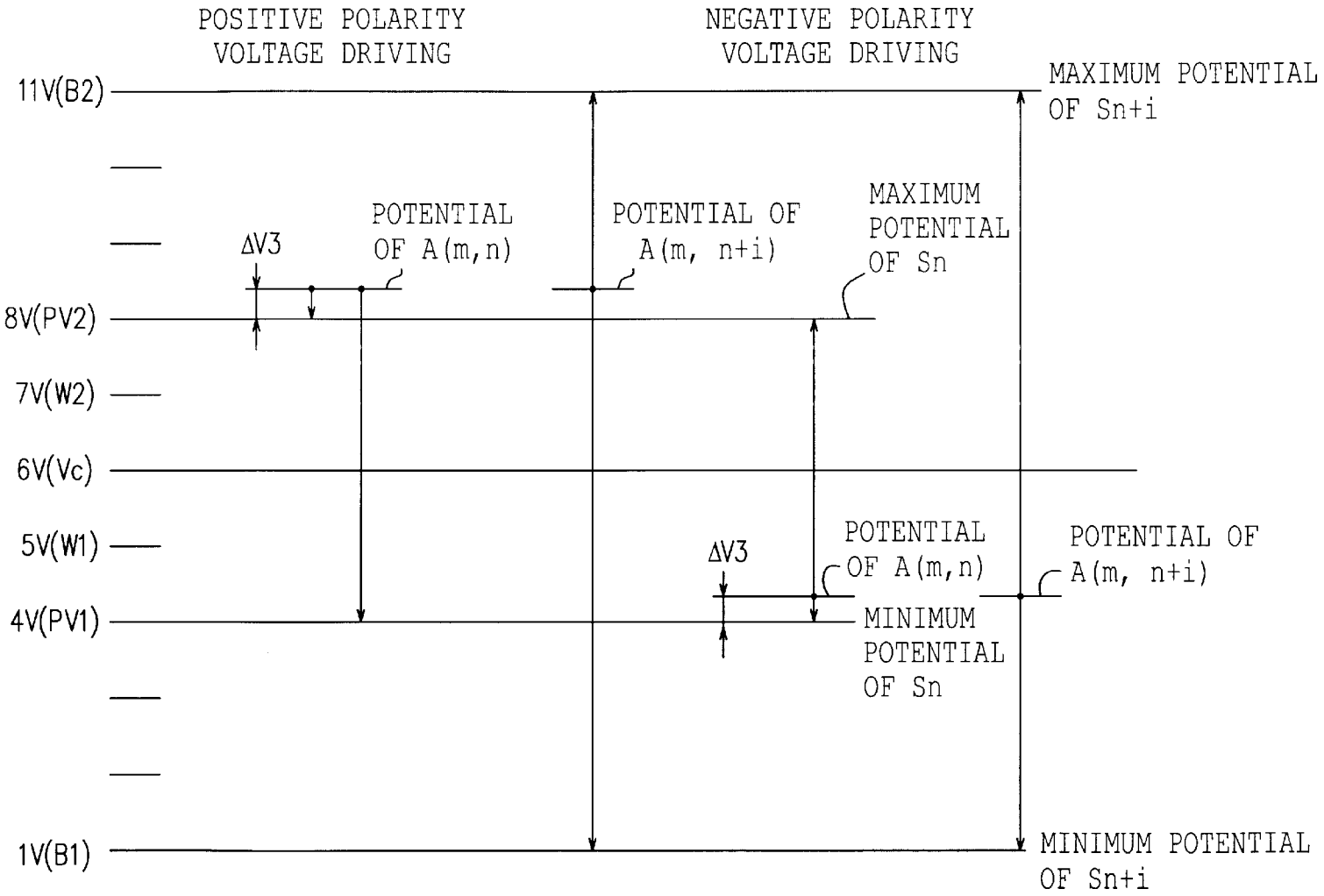
FIG. 8 is a schematic explanatory diagram illustrating leaking when the pre-charge potential in FIG. 7 has been changed.

Now, with the pixel A(m, n) shown in FIG. 15, since intermediate gray scale display is performed by all pixels connected to the data signal line Sn, so during the pre-charging period prior to the positive polarity voltage driving, the data line Sn is pre-charged to the second pre-charging potential PV1 (10.5V). This is the point in which FIG. 7 differs from the conventional arrangement in FIG. 8. With the conventional method shown in FIG. 8, the charging voltage of the pixel A(m, n), which are applied positive polarity voltage, shifts only in the negative direction by means of the leak occurring at the TFT, having been affected by the first and second pre-charging potentials which are lower than the charge voltage to be applied to the data signal line Sn. However, since in the case of FIG. 7, the pre-charging potential PV2 is higher than the charging voltage, the pixel A(m, n) is alternately affected by potentials higher and lower than the charge potential applied to the data signal line, so the charge voltage fluctuates so as to shift in both directions of high and low, and at this point reaches the same fluctuation conditions as the pixel A(m, n+i). Accordingly, when the pixel A(m, n+i) shifts in the direction to become black on the display, the pixel A(m, n) also shifts in the direction to become black on the display, and the effects of optical cross-talk are canceled on the display. In the same manner, when the pixel A(m, n+i) shifts in the direction to become white on the display, the pixel A(m, n) also shifts in the direction to become white on the display, and the effects of optical cross-talk are offset on the display. Thus, according to the present embodiment, optical cross-talk can be made unnoticeable on the display, thereby improving image quality. Incidentally, in the event of driving the liquid crystal layer with negative polarity voltage, the arrangement is a shown in FIG. 7 and there is no problem the same as the conventional arrangement.

Figure 9:
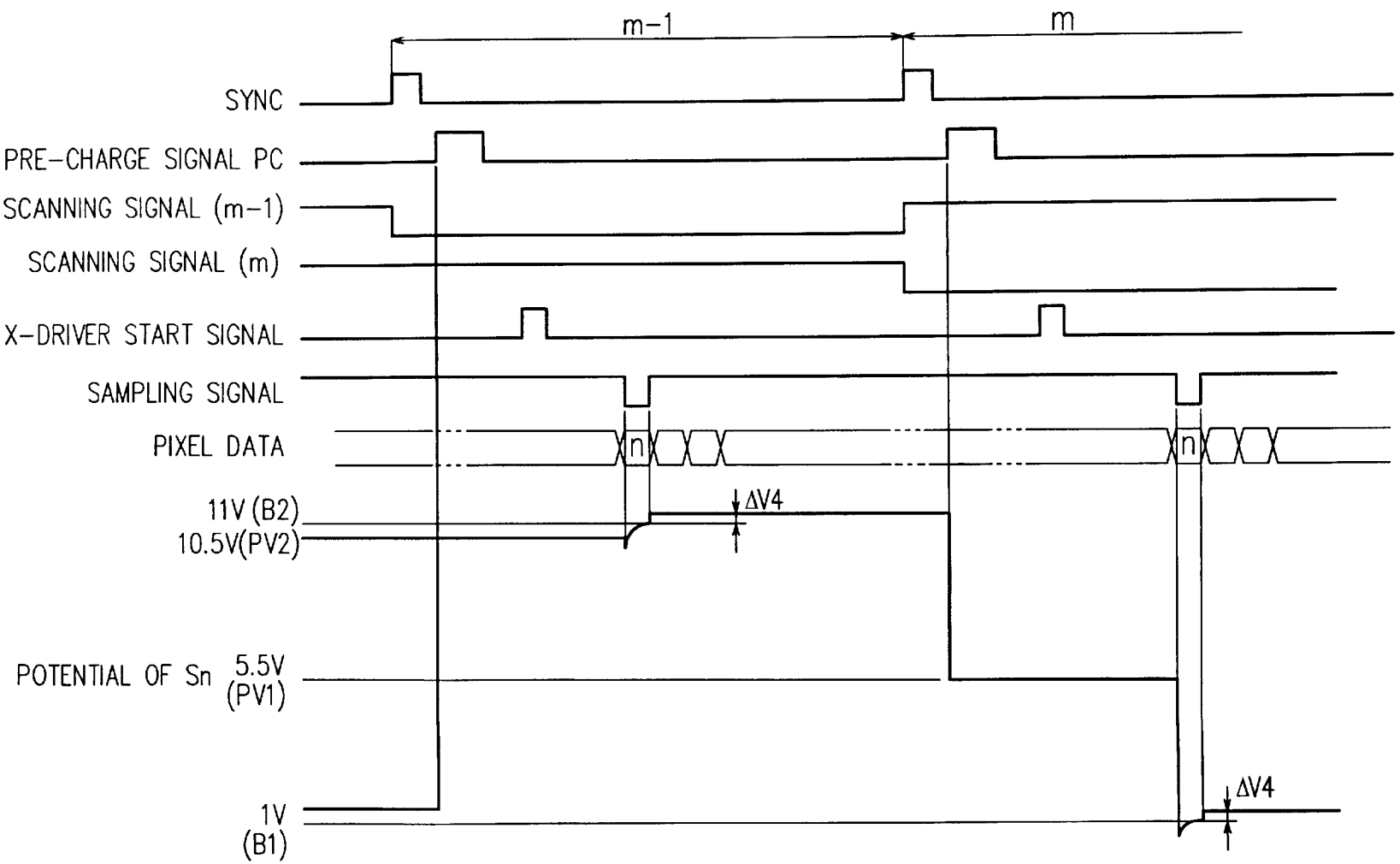
FIG. 9 is a timing chart for describing the operation of the second embodiment of the present invention.

FIG. 9 shows a timing chart of the liquid crystal apparatus according to the present invention in the case that all of the sampling switches 106 shown in FIG. 1 and all of the switching elements 114 are formed of P-channel transistors. Here, FIG. 9 describes displaying of black with both the pixel 120 of the pixel A(m−1, n) shown in FIG. 4 and the pixel 120 of the pixel A(m, n) shown in FIG. 4, in the same manner as with FIG. 5, and describes the change in potential at the data signal line therein.

FIG. 9 is different from FIG. 5 in that the sampling switch 106 which is a P-channel transistor is turned ON when the sampling signal is "low", and the switching element 116 which is a P-channel transistor is turned ON when the sampling signal is "low"

In the present embodiment, as described above, the first pre-charge potential PV1 is set to, e.g., 5.5V, and the second pre-charge potential PV2 is set to, e.g., 10.5V.

The horizontal scanning signal (m−1) is set to "low"by means of the m−1horizontal synchronizing signal SYNC being input. Accordingly, all switching elements 114 connected to the scanning signal line Hm turn ON. Subsequently, the pre-charging signal PC turns "high", and all of the pre-charging switches 172 go ON. Accordingly, the first pre-charging potential PV1 (5.5V) from the first pre-charging power source 174*a* is supplied to the odd-numbered data signal lines S1, S3, . . . , Sn−1, Sn+1, Sn+3, and so forth. On the other hand, the second pre-charging potential PV2 (10.5V) from the second pre-charging power source 174*b* is supplied to the even-numbered data signal lines S2, S4, . . . , Sn, Sn+2, Sn+4, and so forth.

Now, in the event that a black display had been performed by the pixel A(m−2, n) prior to this pre-charging operation, the potential of the data signal line Sn shown in FIG. 9 is close to the black level potential B1(1V). Subsequently, the above pre-charging operation is started, so the data signal line Sn is pre-charged to the second pre-charging potential PV2 (10.5V).

Then, further, data signal sampling is started to all of the pixels connected to the scanning signal line Hm−1 shown in FIG. 4. In order to display black at the pixel A(m−1, n), the positive polarity side black level potential B2 (11V) is supplied to the data signal line Sn throughout the sampling period, via the sampling switch 106. Then, the pixel A(m−1, n) is charged with voltage, thereby performing a black display.

At this time, as shown in the timing chart of FIG. 9, switching noise occurs at the time of turning the sampling switch 106 ON at the trailing edge of the sampling signal, and then the switching noise is superimposed on the data signal line Sn. This switching noise which occurs when turning the sampling In this way, in the event that the sampling switch 106 is a P-channel transistor, the switching noise has undesirable effects on discharging the data signal line Sn. The harshest conditions for discharging the data signal line Sn are when setting the data signal line Sn to the black level potential B2 (11V). Accordingly, with the present embodiment, the second pre-charging potential PV2 is set to 10.5V which is close to the black level potential B2 (11V). Incidentally, in the event that the second pre-charging potential PV2 is exceeds the black level potential B2, the gate potential and source potential of the sampling switch 106 become equal, and there is the danger of leaking. Accordingly, it is preferable to set the second pre-charging potential PV2 so as to be lower the black level potential B2 taking in to potential B2 as possible.

At the leading edge of this sampling signal, the sampling switch 106 is turned OFF, but at this time the voltage rises contrary from the voltage fall aforementioned in the description regarding the switching element 114, and the potential of the data signal line Sn rises, as shown in FIG. 9. The rising voltage ΔV4 can be obtained in the same manner as with the formula which was used for calculating the falling voltage ΔV2 in the above first embodiment.

Accordingly, the voltage charged to the liquid crystal layer of the pixel A (m−1, n) is a voltage which is higher than the above-described original data signal potential by the above-described rising voltage ΔV3 and ΔV4. However, the voltage necessary for black display at each pixel can be applied to the liquid crystal layer of the pixel by setting the common electrode potential which is to be applied to the common electrode formed on the opposing substrate at a higher value taking in to consideration the irregularities of circuit constants. Incidentally, constructing the sampling switch 106 with a CMOS transistor structure can prevent such voltage rising.

Subsequently, the horizontal scanning signal (m−1) enters the "high" state, and the horizontal scanning signal (m) enters the "low" state. The scanning signal line Hm shown in FIG. 4 is selected, and all switching elements 114 connected to this horizontal scanning signal line Hm are turned ON.

Then, following this, pre-charging operation and data writing operation is executed in the same manner as with the scanning signal line Hm−1. However, it should be noted that this time, the pre-charging operation and data writing open are both executed at positive polarity voltage. Accordingly, the switch 190 shown in FIG. 1 is switched over. Consequently, the second pre-charging potential PV2 (5.5V) from the second pre-charging power source 174*b* is applied to the odd-numbered signal lines S1, S3, . . . , Sn−1, Sn+1, Sn+3, and so forth. On the other hand, the first pre-charging potential PV1 (10.5V) from the first pre-charging power source 174*a* is applied to the even-numbered signal lines S2, S4, . . . , Sn, Sn+1, Sn+3, and so forth Let us now discuss the potential of the data signal line Sn during this m'th horizontal scanning period. The potential of the data signal line Sn is pre-charged from a potential for performing black display on pixel A(m−1, n) to a first pre-charging potential PV1 (5.5V). Subsequently, as shown in the timing chart of FIG. 9, at the time of turning ON the sampling switch 106 at the trailing edge of the sampling signal, switching noise is generated, and this is superimposed on the data signal line Sn. The switching noise generated when turning the sampling switch 106 on operates in the direction of temporarily decreasing the potential of the data signal line Sn, and operates in the same direction to discharging the potential of the data signal line Sn to black level potential B1 (1V).

Accordingly, in the m'th horizontal scanning period, the above switching noise operates to speed up the operation of discharging the potential of the data signal line Sn until it reaches the black level potential B1. Thus, by even in the case that the first pre-charging potential PV1 is set higher than the 4V in the conventional arrangement, the potential of the data signal line Sn can be set from the first pre-charging potential to the data signal potential, during the sampling period.

Particularly, the first pre-charging potential PV1 is set at 5.5V, which is higher than the white level potential W1 (5V) at the time of negative polarity voltage driving. The reason is that, during the m'th horizontal scanning period shown in FIG. 9, the data signal line Sn can be set to any data signal potential between white level potential W1 (5V) and black level potential B1 (1V), by means of constantly discharging the data signal line Sn with this 5.5V first pre-charging potential PV1. At this time, the switching noise generated at the time of initiating the sampling period operates to speed up the charging.

Incidentally, as described above, during the m'th horizontal scanning period, the above-described rising voltage ΔV4 occurs at the point at which the sampling switch 172 goes OFF, and so the potential of the data signal line Sn becomes a voltage higher than the black level potential B1 as shown in FIG. 9.

Description of Comparative Example 2

Figure 10:
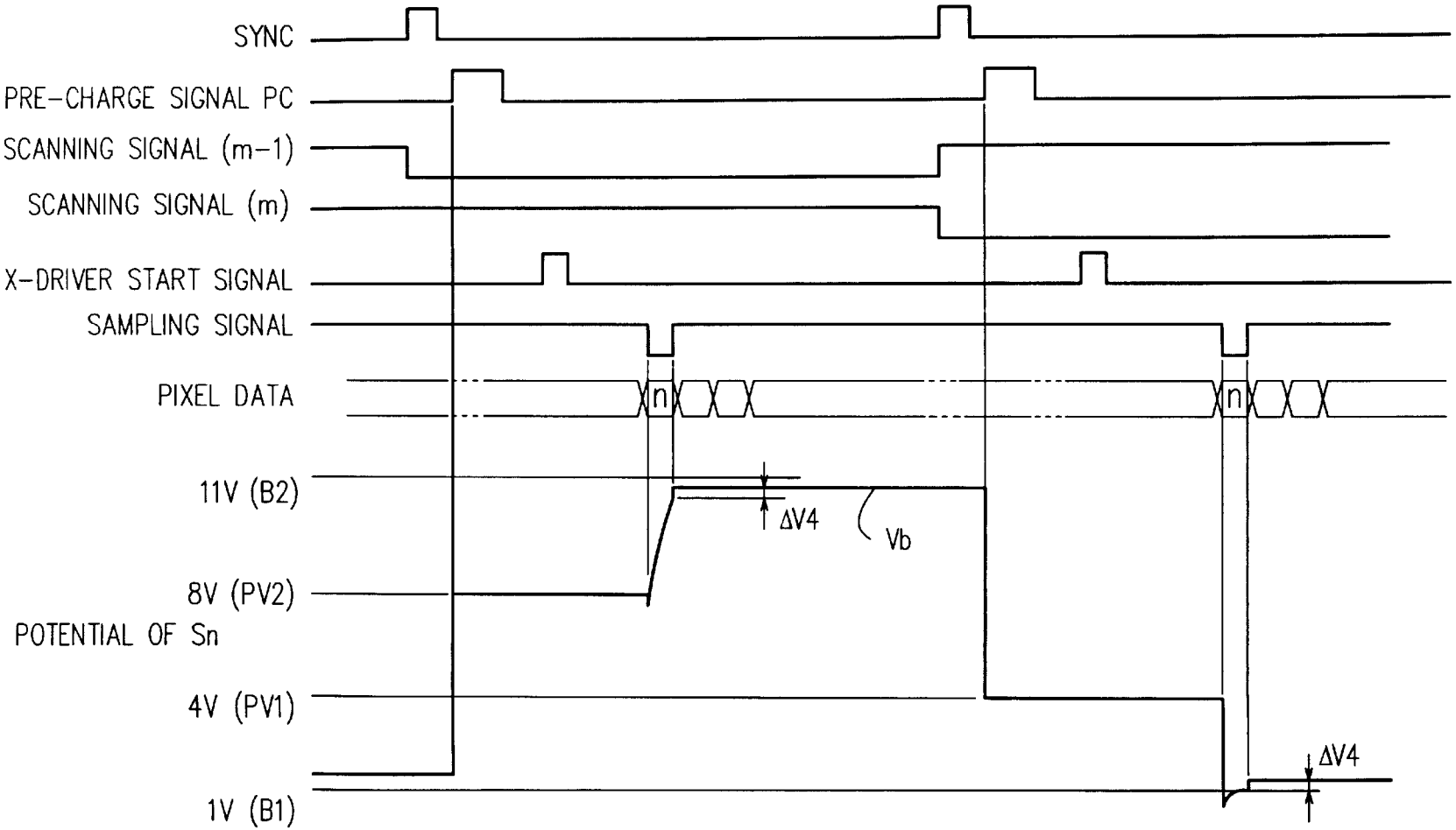
FIG. 10 is a timing chart of a comparative example 2 wherein the pre-charge potential in FIG. 9 has been changed.
Figure 13:
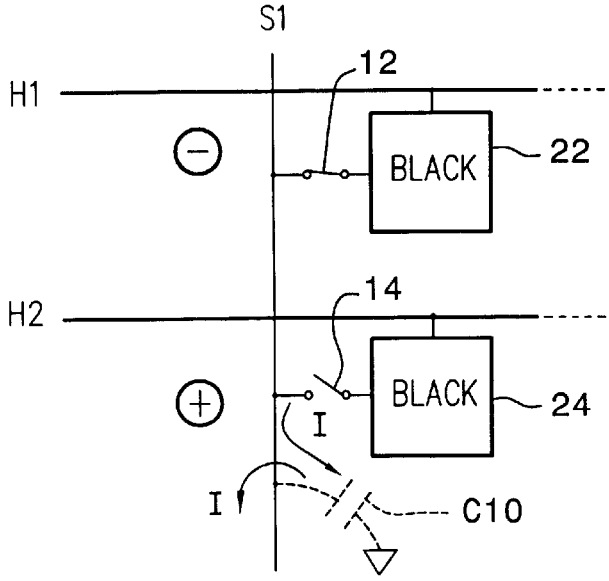
FIG. 13 is a schematic explanatory diagram illustrating two pixels connected to the same data signal line.

FIG. 10 shows a timing chart of a comparative example 2 wherein the first and second pre-charging potentials PV1 and PV2 shown in FIG. 9 are respectively set to the conventional levels of 4V and 8V. During the m−1 horizontal scanning period shown in FIG. 10, undesirable effects of the switching noise cause the sampling period to end before the potential of the data signal line Sn is discharged from the first pre-charging potential PV1 (4V) to the black level potential B1. Accordingly, the potential of the data signal line becomes a potential Vb which is not the data signal potential corresponding with the original black, and it can be understood that the pixel A(m−1, n) is charged with a charge which does not reflect the original data, and thus, image quality deteriorates.

<Third Embodiment>

Electronic equipment using the liquid crystal apparatus described in the above embodiments is comprised of a display information output source 1000, a display information processing circuit 1002, a display driving circuit 1004, a display panel such as a liquid crystal panel 1006, a clock generating circuit 1008, and a power source circuit 1010. The information output source 1000 is comprised of memory such as ROM or RAM, and a synchronizing circuit for performing synchronous output with television signals, and outputs display information such as video signals based on clocks from the clock generating circuit 1008 which is equivalent to the above-described timing circuit block 20.

The display information processing circuit 1002 is equivalent to the above-described data processing circuit block 30, and processes and outputs display information based on clocks from the clock generating circuit 1008. This display information processing circuit 1002 may include the above amplifying/polarity inverting circuits, phase expanding circuits, rotation circuits, etc., and may also include gamma correction circuits, clamping circuits, etc.

The driving circuit 1004 is constructed having the above scanning-side driving circuit 102, data-side driving circuit 104 and pre-charging driving circuit 160, or the data-side driving circuit 104, and drives the display of the pixel area 1006. The power source circuit 1010 supplies electrical power to each of the above circuits.

Figure 19:
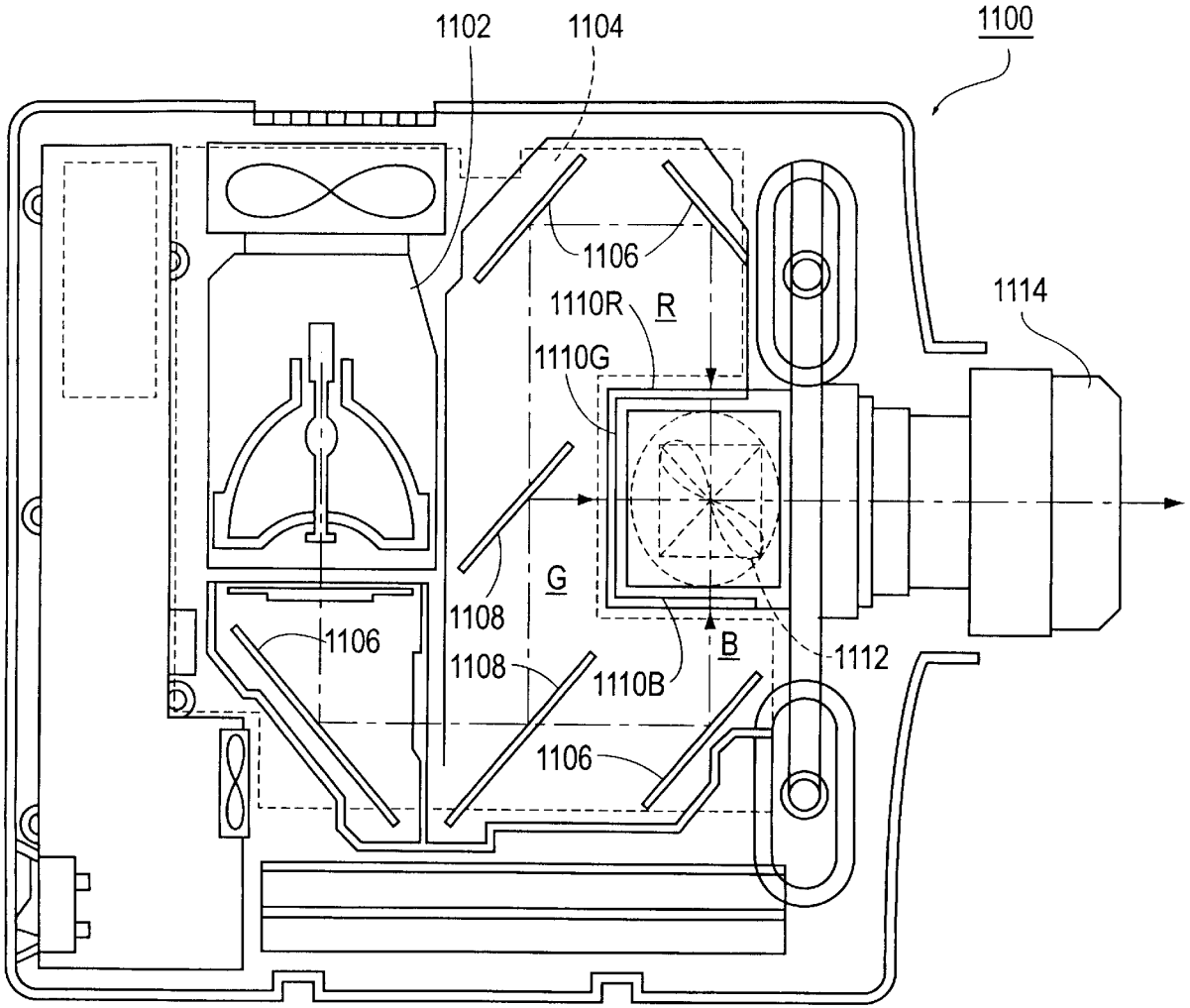
FIG. 19 is a schematic diagram of a liquid crystal projector to which the present invention is applied.
Figure 20:
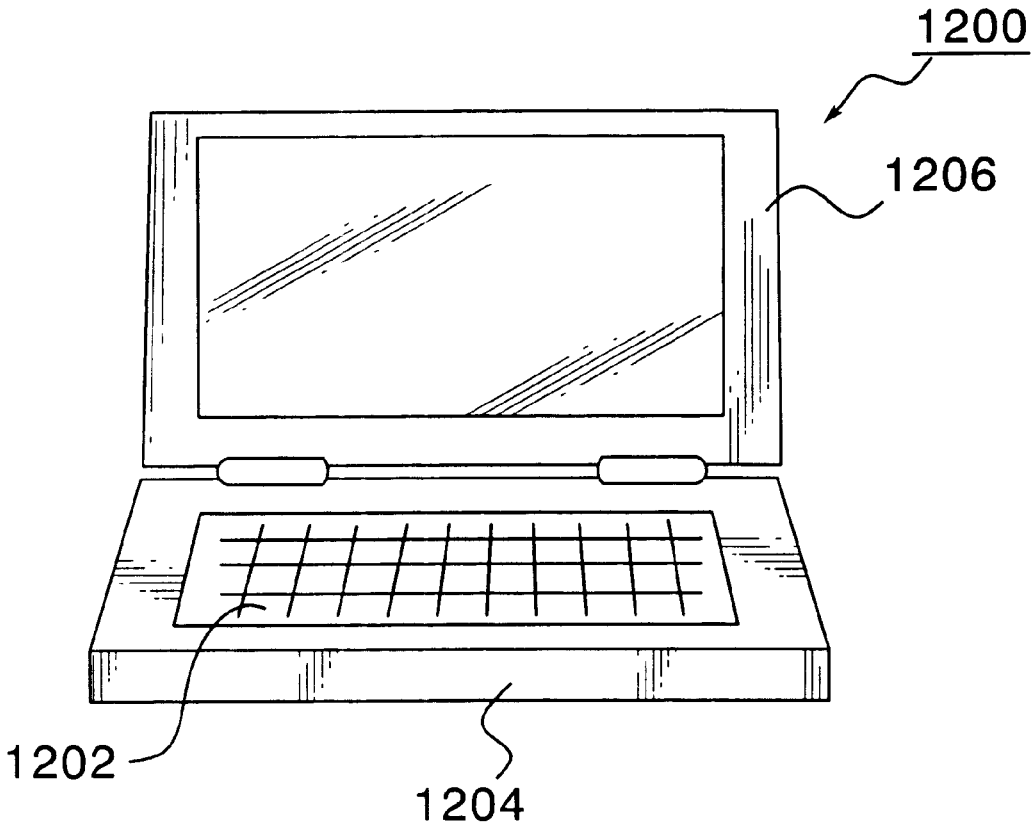
FIG. 20 is a schematic diagram of a personal computer (PC) to which the present invention is applied.

Equipment which can be thus constructed includes the following examples: the liquid crystal projector shown in FIG. 19, the multimedia-capable personal computer (PC) shown in FIG. 20 and engineering workstation (EWS), pagers, cellular telephones, word processors, televisions, viewfinder-type or monitor-viewing-type video recorders, electronic notebooks, electronic calculators, car navigation apparatus, POS terminals, devices having touch-panels, and so forth.

The liquid crystal projector shown in FIG. 19 is a projection-type projector using a transmittance-type liquid crystal panel as a light valve, and includes a prism-synthesis optical system, for example. In FIG. 19, at the projector 1100, projected light cast from the white-light source lamp unit 1102 is divided into the three primary colors R, G, and B by a plurality of mirrors 1106 and two dichroic mirrors 1108, at the inside of light guide 1104. The light is modulated by three active-matrix type liquid crystal panels 1110R, 1110G, and 1110B, which display the image of each color, and the modulated light is cast into the dichroic prism 1112 from three directions.

At the dichroic prism 1112, the red R and blue Bright is bent 90°, and the green light G proceeds directly so an image of each of the colors is synthesized, and a multiple color image is projected on a screen or the like through the projecting lens 1114. The projection-type projector according to the present embodiment uses the liquid crystal apparatus shown in the first and second embodiments, so the aforementioned first pre-charging potential PV1 and the aforementioned second pre-charging potential PV2 are set so as to be non-symmetrical to the intermediate potential of the voltage amplitude to be applied to the pixels, thereby preventing optical cross-talk in the projection-type display device.

The personal computer 1200 shown in FIG. 20 has a main unit 1204 provided with a keyboard 1202, and a liquid crystal display screen 1206.

The present invention is by no means restricted to the above embodiments; rather, various variations can be made within the scope and spirit of the present invention. For example, the present invention is not restricted to application to the driving of the above-described various types of liquid crystal panels, and can also be applied to image display devices using electro-luminescence, plasma display, CRT, and so forth.

What is claimed is:

1. A liquid crystal apparatus including switching elements which are electrically connected to a liquid crystal layer being provided to each of a plurality of pixels formed by crossing a plurality of data signal lines and a plurality of scanning signal lines, being driven by inverting a polarity of a voltage applied to said liquid crystal layer at a predetermined interval, said liquid crystal apparatus comprising:

a scanning-side driving circuit that supplies to said plurality of scanning signal lines scanning signals which select at least one of said plurality of scanning signal lines;

a data-side driving circuit that supplies said data signals to said plurality of data signal lines; and a plurality of pre-charging switching elements which pre-charge each of said plurality of data signal lines with a positive or negative pre-charge potential which has a same polarity as the voltage to be applied to the liquid crystal layer of said pixels based on said data signals, before said data signals are supplied to each of said plurality of data signal lines;

said data signals change at a time of applying negative polarity voltage to said liquid crystal layer within a range of a negative data voltage amplitude between a first potential and a second potential higher than the first potential, and at a time of applying positive polarity voltage to said liquid crystal layer, said data signals change within a range of a positive data voltage amplitude between a third potential higher than said second potential and a fourth potential higher than the third potential, said positive polarity and negative polarity pre-charge potentials being set so as to be non-symmetrical to a center potential of the data voltage amplitude between said first and fourth potentials, said negative polarity pre-charge potential being set so as to be closer in magnitude to said first potential than a center potential of said negative polarity data voltage amplitude.

2. The liquid crystal apparatus according to claim 1, said switching elements being formed of N-channel transistors.

3. The liquid crystal apparatus according to claim 1, further comprising a plurality of sampling switching elements that sample said data signals supplied to each of said data signal lines, based on sampling signals output from said data-side driving circuit, each of said plurality of sampling switching elements being formed of N-channel transistors.

4. The liquid crystal apparatus according to claimed 2, said N-channel transistor being a MOS transistor or thin-film transistor.

5. The liquid crystal apparatus according to claim 1, said negative polarity pre-charge potential being higher than said first potential.

6. The liquid crystal apparatus according to claim 1, said positive polarity pre-charge potential being lower than said third potential.

7. The liquid crystal apparatus according to claim 1, further comprising:

a first pre-charge line connected to said pre-charging switching elements for supplying either positive polarity or negative polarity pre-charge potential to odd-numbered said data signal lines; and a second pre-charge line connected to said pre-charging switching elements for supplying either positive polarity or negative polarity pre-charge potential to even-numbered said data signal lines, a combination of connections between said first and second pre-charge lines with said positive polarity and negative polarity pre-charge potentials being switched each time at least one of said plurality of scanning signal lines is selected.

8. A projection-type display device, comprising:

a light source;

a liquid crystal apparatus according to claim 1 for modulating incident light from said light source; and a projecting optical device that projects light modulated by said liquid crystal apparatus.

9. An electronic equipment, having: the liquid crystal apparatus according to claim 1.

10. A liquid crystal apparatus including switching elements which are electrically connected to a liquid crystal layer being provided to each of a plurality of pixels formed by crossing a plurality of data signal lines and a plurality of scanning signal lines, being driven by inverting a polarity of a voltage applied to said liquid crystal layer at a predetermined interval, said liquid crystal apparatus comprising:

a scanning-side driving circuit that supplies to said plurality of scanning signal lines scanning signals which select at least one of said plurality of scanning signal lines;

a data-side driving circuit that supplies said data signals to said plurality of data signal lines; and a plurality of pre-charging switching elements which pre-charge each of said plurality of data signal lines with a positive or negative pre-charge potential which has the same polarity as the voltage to be applied to the liquid crystal layer of said pixels based on said data signals, before said data signals are supplied to each of said plurality of data signal lines;

said data signals change at a time of applying negative polarity voltage to said liquid crystal layer within a range of a negative data voltage amplitude between a first potential and a second potential higher than the first potential, and at a time of applying positive polarity voltage to said liquid crystal layer, said data signals change within a range of a positive data voltage amplitude between a third potential higher than said second potential and a fourth potential higher than the third potential, said positive polarity and negative polarity pre-charge potentials being set so as to be non-symmetrical to a center potential of the data voltage amplitude between said first and fourth potentials, and such that said positive polarity pre-charge potential is set so as to be closer in magnitude to said fourth potential than the center potential of said positive polarity data voltage amplitude.

11. The liquid crystal apparatus according to claim 10, said switching elements being formed of P-channel transistors.

12. The liquid crystal apparatus according to claim 10, further comprising a plurality of sampling switching elements for sampling said data signals supplied to each of said data signal lines, based on sampling signals output from said data-side driving circuit, each of said plurality of sampling switching elements being formed of P-channel transistors.

13. The liquid crystal apparatus according to claim 11, the P-channel transistor being a MOS transistor or thin-film transistor.

14. The liquid crystal apparatus according to claims 10, said negative polarity pre-charge potential being lower than said fourth potential.

15. The liquid crystal apparatus according to claim 10, said negative polarity pre-charge potential being higher than said second potential.

16. A method for driving a liquid crystal apparatus that includes switching elements which are electrically connected to a liquid crystal layer being provided to each of a plurality of pixels formed by intersecting a plurality of data signal lines and a plurality of scanning signal lines, by inverting a polarity of a voltage applied to said liquid crystal layer at a predetermined interval, said method comprising:

supplying to said plurality of scanning signal lines scanning signals which select at least one of said plurality of scanning signal lines;

supplying said data signals to each of said plurality of data signal lines;

pre-charging each of said plurality of data signal lines with a positive or negative pre-charge potential which has a same polarity as the voltage applied to the liquid crystal layer of said pixels based on said data signals, before said data signals are supplied to each of said plurality of data signal lines;

said data signals change at the time of applying negative polarity voltage to said liquid crystal layer within a range of a negative data voltage amplitude between a first potential and a second potential higher than the first potential, and at a time of applying positive polarity voltage to said liquid crystal layer, said data signals change within a range of a positive data voltage amplitude between a third potential higher than said second potential and a fourth potential, higher than the third potential, said positive polarity and negative polarity pre-charge potential being set so as to be non-symmetrical to a center potential of the data voltage amplitude between said first and fourth potentials, and said negative polarity pre-charge potential being set so as to be closer in magnitude to said first potential than a center potential of said negative polarity data voltage amplitude.

17. The method for driving a liquid crystal apparatus according to claims 16, said switching elements being formed of N-channel transistors.

18. A method for driving a liquid crystal apparatus including switching elements which are electrically connected to a liquid crystal layer being provided to each of a plurality of pixels formed by intersecting a plurality of data signal lines and a plurality of scanning signal lines, by inverting a polarity of a voltage applied to said liquid crystal layer at a predetermined interval, said method comprising:

supplying to said plurality of scanning signal lines scanning signals which select at least one of said plurality of scanning signal lines;

supplying said data signals to each of said plurality of data signal lines;

pre-charging each of said plurality of data signal lines with a positive or negative pre-charge potential which has the same polarity as the voltage applied to the liquid crystal layer of said pixels based on said data signals, before said data signals are supplied to each of said plurality of data signal lines;

said data signals change at the time of applying negative polarity voltage to said liquid crystal layer within a range of a negative data voltage amplitude between a first potential and a second potential higher than the first potential, and at a time of applying positive polarity voltage to said liquid crystal layer, said data signals change within a range of a positive data voltage amplitude between a third potential higher than said second potential and a fourth potential higher than the third potential, said positive polarity and negative polarity pre-charge potential being set so as to be non-symmetrical to a center potential of the data voltage amplitude between said first and fourth potentials, and said positive polarity pre-charge potential being set so as to be closer in magnitude to said fourth potential than the center potential of said positive polarity data voltage amplitude.

19. The method for driving a liquid crystal apparatus according to claim 18, said switching elements being formed of P-channel transistors.

* * * * *